US010485341B2

(12) United States Patent
Dash et al.

(10) Patent No.: US 10,485,341 B2
(45) Date of Patent: Nov. 26, 2019

(54) MULTI-FUNCTION TABLE

(71) Applicant: StoreBound LLC, New York, NY (US)

(72) Inventors: Evan Dash, Port Washington, NY (US); Yiyang Zhang, Tainan (TW); Defang Chen, Guangdong (CN); Xiqing Zhong, Guangdong (CN); Yijun Wang, Guangdong (CN)

(73) Assignee: STOREBOUND LLC, New York, NY (US)

( * ) Notice: Subject to any disclaimer, the term of this patent is extended or adjusted under 35 U.S.C. 154(b) by 6 days.

(21) Appl. No.: 15/951,852

(22) Filed: Apr. 12, 2018

(65) Prior Publication Data

US 2018/0295986 A1 Oct. 18, 2018

Related U.S. Application Data

(60) Provisional application No. 62/484,633, filed on Apr. 12, 2017.

(51) Int. Cl.

| | |
|---|---|
| ***A47B 83/04*** | (2006.01) |
| ***A47B 13/08*** | (2006.01) |
| ***A47B 31/02*** | (2006.01) |
| *A47B 88/919* | (2017.01) |
| *F21V 33/00* | (2006.01) |
| *A47B 83/00* | (2006.01) |
| *F21Y 115/10* | (2016.01) |

(52) U.S. Cl.

CPC ..... *A47B 83/04* (2013.01); *A47B 13/08* (2013.01); *A47B 31/02* (2013.01); *A47B 88/919* (2017.01); *A47B 2083/003* (2013.01); *A47B 2210/175* (2013.01); *A47B 2220/0091* (2013.01); *F21V 33/0012* (2013.01); *F21Y 2115/10* (2016.08)

(58) Field of Classification Search

CPC ..... A47B 13/08; A47B 83/04; A47B 88/919; A47B 2083/003; A47B 2210/175; A47B 2220/0091; F21V 33/0012

USPC ..... 312/237, 7.1

See application file for complete search history.

(56) References Cited

U.S. PATENT DOCUMENTS

| | | | | |
|---|---|---|---|---|
| 1,351,097 A | | 8/1920 | Cook | |
| 1,492,428 A | | 4/1924 | Cook | |
| 3,292,931 A | | 12/1966 | Grunwald | |
| 3,572,873 A | * | 3/1971 | Harting, Jr. ..... | A47B 81/062 312/237 |

(Continued)

*Primary Examiner* — Daniel J Troy
*Assistant Examiner* — Timothy M Ayres
(74) *Attorney, Agent, or Firm* — Belles Katz LLC

(57) ABSTRACT

A furniture unit in the form of a multi-function table having a base, a top surface attached to an upper part of the base, a refrigeration assembly located within the base and defining a refrigerated storage area accessible by a drawer, and a non-refrigerated storage assembly located within the base and accessible by one or more drawers. The top surface may be the upper most surface of the table and can cover substantially the entire table. The table may include other features including lighting, audio speakers, power outlets, USB ports, and a wireless charging pad. Operation of the refrigeration assembly and various features of the table may be controlled by a control section and programmable controller provided with the table. The controller may communicate wirelessly with a personal electronic device operable to program the controller and control operation of the features of the table.

20 Claims, 20 Drawing Sheets

(56) References Cited

U.S. PATENT DOCUMENTS 3,732,702 A * 5/1973 Desch ..... A47B 67/005 219/219
4,571,740 A * 2/1986 Kirby ..... A45C 11/20 206/216
4,581,902 A 4/1986 Starck et al.
4,939,912 A * 7/1990 Leonovich, Jr. ..... A45C 11/20 312/237
5,235,822 A * 8/1993 Leonovich, Jr. ..... A45C 15/00 206/542
5,415,010 A 5/1995 Woo
6,484,512 B1 * 11/2002 Anderson ..... F25B 21/04 62/3.2
6,564,570 B2 5/2003 Koike et al.
6,715,299 B2 * 4/2004 Kim ..... A45D 44/00 62/3.6
6,769,260 B2 * 8/2004 Lee ..... F25D 29/008 62/259.2
7,418,747 B1 * 9/2008 Myers ..... A47C 19/022 312/283
7,519,195 B2 * 4/2009 Hesketh ..... B25H 3/00 181/145
7,744,252 B2 * 6/2010 Maxik ..... A47B 96/021 362/294
8,038,235 B2 10/2011 Lowery et al.
8,506,023 B2 * 8/2013 Goldie ..... E05G 1/04 312/204
8,517,478 B2 * 8/2013 Diemel ..... A47B 67/02 312/227
9,124,308 B2 * 9/2015 Metcalf ..... A47C 7/70
D752,905 S 4/2016 Healy et al.
9,722,449 B2 * 8/2017 Jung ..... H02J 7/025
9,970,651 B2 * 5/2018 Wang ..... F21V 33/0012
10,037,673 B1 * 7/2018 Gray ..... G08B 5/36
10,084,337 B1 * 9/2018 Cozzi ..... H02J 7/025
10,212,519 B2 * 2/2019 Nelson ..... A47C 7/72
2008/0203868 A1 * 8/2008 Leclear ..... D06F 39/00 312/237
2012/0091797 A1 * 4/2012 Kesler ..... B60L 3/0069 307/11
2013/0327064 A1 12/2013 Stein
2015/0320203 A1 * 11/2015 Mandon ..... A47B 21/06 108/20
2016/0049034 A1 * 2/2016 Stradiota ..... G07C 9/00563 340/5.53
2017/0258223 A1 * 9/2017 Stampler ..... A47B 81/005
2018/0014097 A1 * 1/2018 Lin ..... H04R 1/025
2018/0191178 A1 * 7/2018 Byrne ..... A47C 7/72

* cited by examiner

MULTI-FUNCTION TABLE

CROSS-REFERENCE TO RELATED APPLICATIONS

The present application claims the benefit of priority to U.S. Provisional Application No. 62/484,633 filed Apr. 12, 2017; the entirety of which is incorporated herein by reference.

FIELD OF INVENTION

The present invention generally relates to tables, and more particularly relates to tables having multiple functions including but not limited to coffee and side tables.

BACKGROUND

Tables such as coffee tables are an integral part of most living areas in residential houses. Such tables are often located near a couch or chair to provide a place to set drinks, food, magazines, television remote controls, and other things that people sitting on the couch desire to have in close proximity for easy use.

Things that people in a living area often desire are refrigerated beverages or food items. Such items are usually stored in a refrigerator in a kitchen, garage, or other room remote from the living area. This requires people using the living area to get up and go to the area in which the refrigerator is located to retrieve the refrigerated beverages or food items.

BRIEF SUMMARY

The present invention provides a solution to the above described problem by providing a multifunction table. While the invention is initially described with regard to a coffee table, the invention can also be embodied in other tables such as a side table which can function as night stand in some implementation as further disclosed herein.

Embodiments of the invention solve the problem of having to get up and retrieve refrigerated and/or frozen items from a different room by providing a refrigerator and/or freezer in a table such as a coffee table. For simplicity, the term "refrigerator" will be understood to include devices that cool to a temperature below room temperature but above freezing, freeze or both. By incorporating a refrigerator into the table, people in the living area where the table is located can retrieve a refrigerated beverage or food item without having to leave the living area or, in some cases, even get up from their seat.

By providing a drawer that moves in and out of the refrigerated space, access is provided to a user of a seating area at a convenient location and orientation. This is contrary to normal small sized refrigerators which have a pivoting door instead of a drawer. Due to the spacing that often exists between a coffee table and a couch, for example, a drawer provides better access and easier opening than does a pivoting door.

Most refrigerators require an electrically-driven refrigerating system that generates heat outside of the refrigerated space. This heat must be removed from portions of the refrigerating system, such as a compressor, in order for the refrigerating system to work. Embodiments of the invention include audio speakers integrated in the table. The audio speakers can have air ports that permit movement of air between the back side of speaker drivers and the environment outside of the speakers. In some embodiments, these air ports open into an area inside the table that includes the compressor and/or other heat generating portions of the refrigerating system. The air moved by the speakers through the air ports can, in turn, move the air directly adjacent to the heat generating portions to create air circulation around the heat generating portions. This air circulation can remove heat from the heat generating portions to help cool them.

Each of the multifunction tables described herein may further be a "smart" table comprising various electronics and ports configured for providing audio, lighting, electronic device charging (e.g. cell phones), and other functions/features as described herein.

In one aspect, a multifunction table includes: a base formed by a removable rear panel, a right side panel, a left side panel, a top panel, and a bottom panel; a top surface defined by the top panel; a refrigeration assembly located within the base and below the top surface, the refrigeration assembly having a refrigerated storage area that is accessible by a slideable drawer; and a non-refrigerated storage assembly located within the base and below the top surface, the non-refrigerated storage assembly having a slideable drawer; wherein the top surface is the upper most surface of the table and covers substantially all of the base of the table.

In another aspect, a multifunction table includes: a base; a top panel attached to an upper portion of the base, the top panel having a top surface; a removable rear panel attached to a rear area of the base; a refrigeration unit located within the base and below the top panel; a non-refrigerated storage assembly located within the base and below the top panel; a ventilated air space within the base, the air space being located between the removable rear panel and the refrigeration unit; and a pair of speakers each having a speaker driver.

In another aspect, a multifunction table includes; a housing formed by a removable rear panel, a right side panel, a left side panel, a top panel, and a bottom panel, the housing having a front side; a top surface defined by the top panel; a refrigeration assembly located within the housing and below the top surface, the refrigeration assembly having a refrigerated storage area that is accessible by a slideable drawer; a non-refrigerated storage assembly located within the base and below the top surface, the non-refrigerated storage assembly having a slideable drawer; and a speaker insert removably inserted in a frontally open receptacle of the housing above the drawers, the speaker insert defining a pair of laterally spaced apart speaker housings each including a speaker driver and a frontally open storage compartment 930 disposed between the speaker housings.

In yet another aspect, the invention is directed to a table having a base; a top surface attached to an upper area of the base; a refrigeration assembly located within the base and below the top surface, the refrigeration assembly having a refrigerated storage area that is accessible by a drawer; and a non-refrigerated storage assembly located within the base and below the top surface, the non-refrigerated storage assembly having a drawer. The top surface is the upper most surface of the table and covers substantially all of the table (i.e. width and depth).

In some embodiments, the table has a rectangular parallelepiped or cuboid configuration having a length, a height, and a width. In some embodiments, the height is smaller than the length, and the height is smaller than the width.

In some embodiments, the non-refrigerated storage assembly has a plurality of drawers.

Some embodiments include a first audio speaker and a second audio speaker. In some embodiments, the first audio speaker projects sound out of a first side surface of the table, and the second audio speaker projects sound out of a second side surface of the table, and the first side surface and the second side surface are opposite sides of the table.

Some embodiments include a rear panel attached to the base, an upper panel attached to the base, and a bottom panel attached to the base.

Some embodiments include an air space within the base, the air space being located between the rear panel and the refrigeration section. In some embodiments, each of the first and second audio speakers has a driver and a port, the port fluidly connecting a rear side of the driver and the air space.

In some embodiments, the refrigeration assembly includes a compressor located in the air space, and the air space is a compressor chamber.

In some embodiments, when the driver is operating, the driver moves air in and out of the port such that air is moved around the compressor.

In some embodiments, a gap is provided between the rear panel and upper panel, the gap allowing air to pass from the air space to the environment outside the table. In some embodiments, the gap is a uniform gap around the rear panel. Some embodiments include ventilation openings in the bottom panel, the ventilation openings being fluidly connected to the air space.

Some embodiments include a control panel that controls functions of the refrigeration assembly. In some embodiments, the control panel further comprises controls that control functions of the first and second audio speakers.

Some embodiments include an electrical receptacle for providing electrical power to a device external to the table.

Some embodiments include a USB port for connecting an external music source to the first and second audio speakers.

Further areas of applicability of the present invention will become apparent from the detailed description provided hereinafter. It should be understood that the detailed description and specific examples, while indicating particular embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
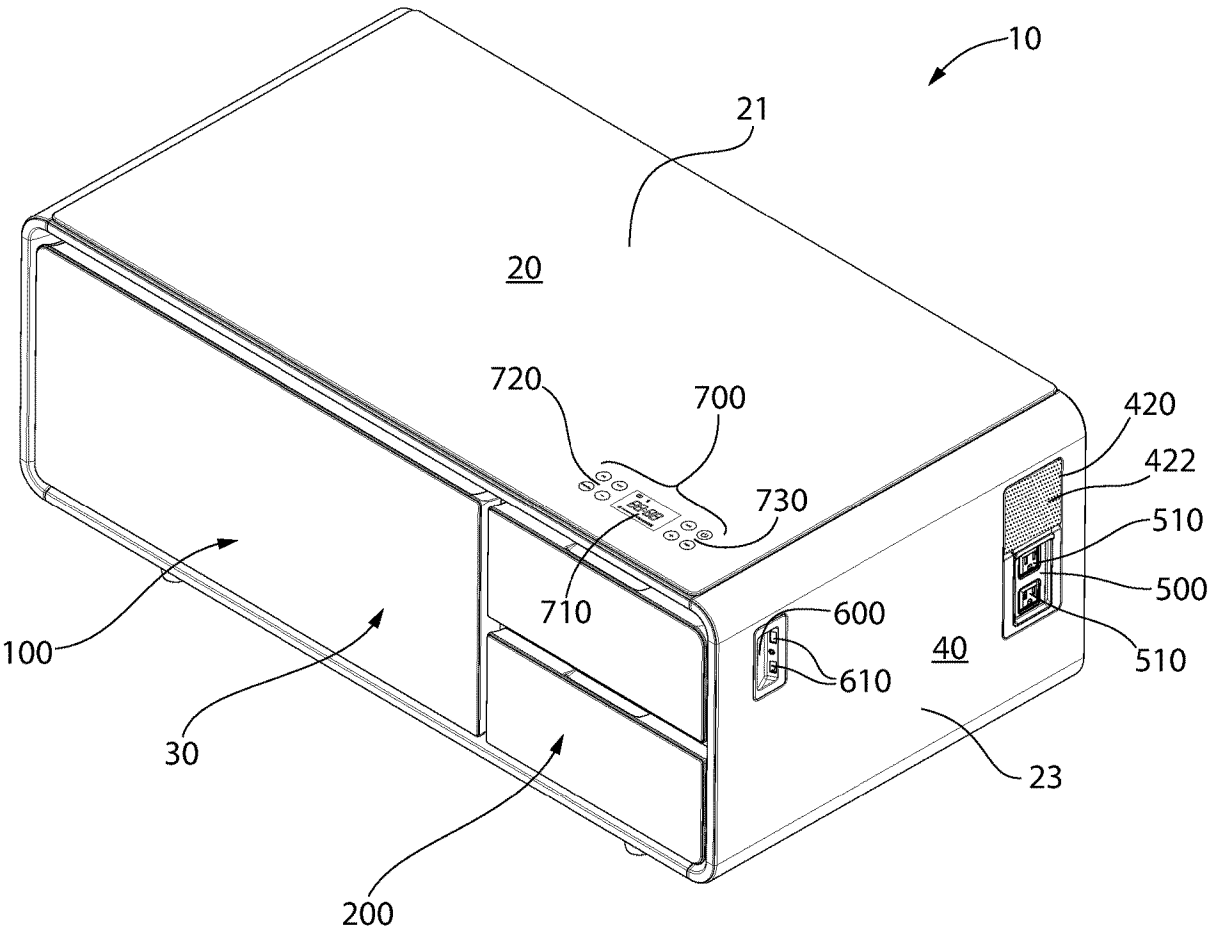
FIG. 1 is a front perspective view of an embodiment of a multi-function table according to the present disclosure.

The following description of embodiments is merely exemplary in nature and is in no way intended to limit the invention, its application, or uses.

With reference to the drawings, hereinafter, description will be given of tables according to embodiments based on the present invention. While the invention is exemplified herein as a coffee table, it is to be understood that the inventive concepts discussed herein can be applied other tables, including without limitation, end tables, lamp tables, sofa tables, and any other type of table. As a result, while a coffee table is used to describe the invention, it is noted that the table can be any of the alternate devices listed above, or any other table.

The description of illustrative embodiments according to principles of the present invention is intended to be read in connection with the accompanying drawings, which are to be considered part of the entire written description. In each of the following embodiments, if mention is made of counts, quantities and the like, the scope of the present invention is not necessarily limited to the counts, quantities and the like unless otherwise specified. In the respective embodiments to be described below, the same components and corresponding components are denoted with the same reference characters, and therefore the duplicative description is not repeated in some instances.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "coupled," "connected," "interconnected," and the like refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features.

Figure 2:
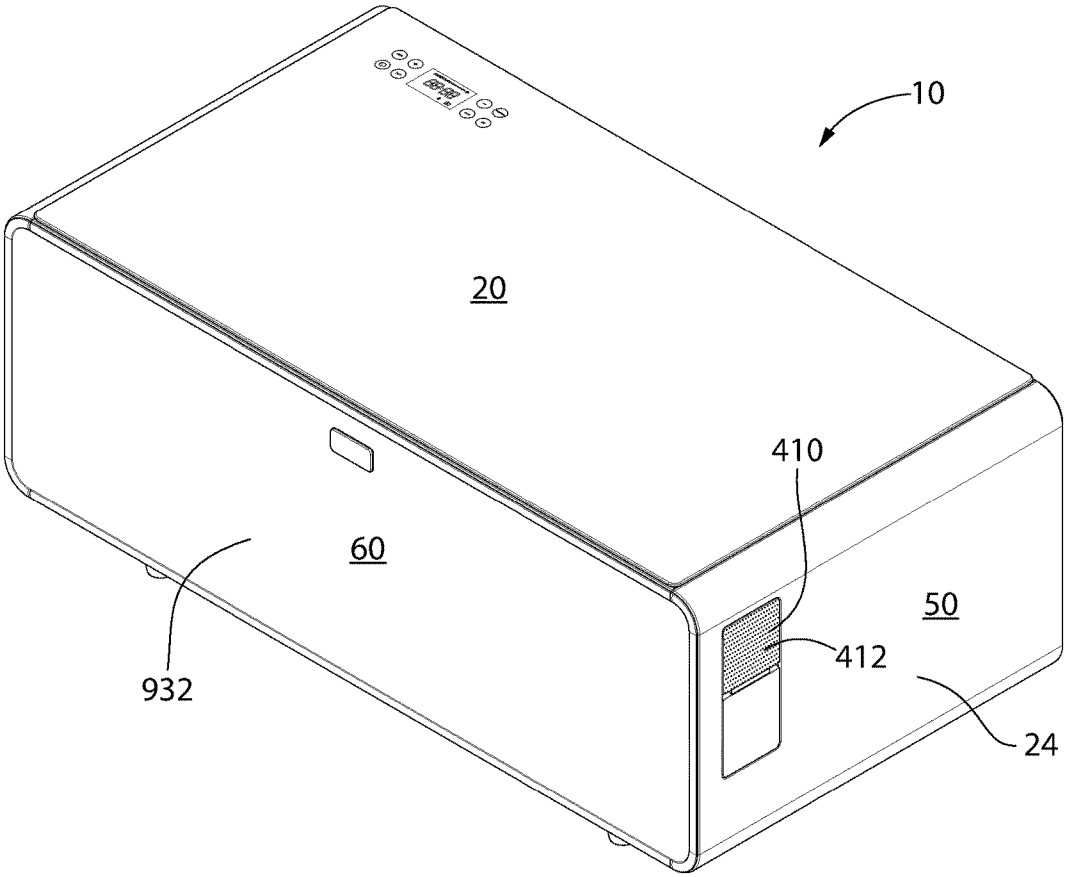
FIG. 2 is a rear perspective view of the table shown in FIG. 1.
Figure 3:
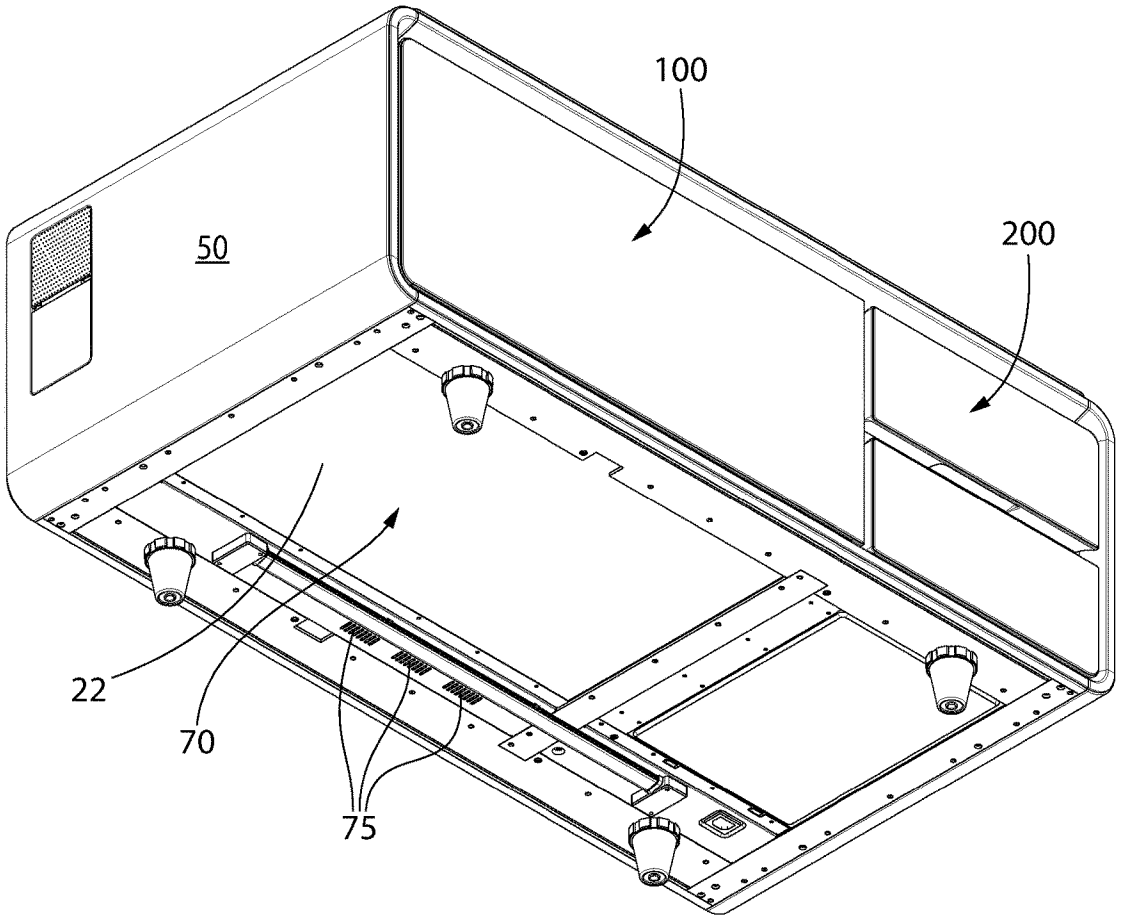
FIG. 3 is a bottom perspective view of the table shown in FIG. 1.

FIGS. 1-3 illustrate an example of a furniture unit such as a table 10 having a primary housing or base comprising a plurality of panels including top panel 21, bottom panel 22, right side panel 23, left side panel 24, and removable rear panel 932 which define a forwardly open primary cavity 12. The panels define a top 13 including a horizontal top or upper surface 20, a front side 30, a right side 40, a left side 50, a rear side 60 and a bottom 70. The front side 30, right side 40, left side 50, rear side 60 and bottom 70 can be considered to collectively define a base which supports the top surface 20. Table 10 has a rectangular parallelpiped or cuboid configuration in one non-limiting embodiment. This example is a table with a horizontal rectangular upper surface, a horizontal rectangular bottom, and vertical rectangular front, back and sides. Adjoining corner regions between these may be rounded in one embodiment as shown for esthetics and practical purposes to avoid sharp edge for users. Other embodiments of the invention, however, can have a different number of sides, use shapes other than rectangles, and use angles other than 90°. In this example, upper surface 20 is flat and covers substantially all of the entirety of the table from side to side and front to rear.

Table 10 may be shaped and configured to function as a coffee table. Accordingly, in one embodiment table 10 may have a length (measured between right side 40 and left side 50) which is at least two-times the height of the table (measured from the top to bottom of front side 30—excluding the legs 370).

This example of table 10 has a refrigeration unit or assembly 100 and a non-refrigerated storage unit or assembly 200 with openings located on and accessible from the front side 30. In this example, refrigeration assembly 100 is accessed by a single drawer (discussed below) and storage assembly 200 includes two drawers (discussed below). Other embodiments have different numbers of drawers and/or pivoting doors instead of drawers, or a combination of the two. Refrigeration assembly 100 may be configured as a thermoelectric refrigeration unit in one embodiment.

FIG. 2 shows a removable rear panel 932 covering rear side 60 of table 10. Rear panel 932 may be solid in one embodiment as shown, which is advantageous for coffee table 10 which is viewed from all sides. This rear panel can be removable to provide access to the rear sides of refrigeration assembly 100, storage assembly 200, speaker housings 410, 420, and/or other components of table 10. Rear side 60 can also include ventilation openings to provide ventilation air to the area behind refrigeration assembly 100 and speaker housings 410, 420. In other embodiments, rear side 60 is covered with a mesh or perforated panel to provide ventilation. FIG. 3 shows bottom 70 having a plurality of panels making up the bottom of table 10. In other embodiments, a single panel covers the entirety of the bottom of table 10. FIG. 3 shows three ventilation openings 75 that permit air to flow into the space behind refrigeration assembly 100 and storage assembly 200. More or fewer than three openings can alternatively be provided or an entire panel in the bottom side 70 can be a perforated panel.

Upper surface 20 includes control section 700 that controls various functions of the table. In this example, control section 700 includes a display 710, refrigerator controls 720, and sound controls 730 for audio speakers that are either part of, or separate from, table 10. Display 710 can show various information depending upon what controls are being used. For example, display 710 can show a refrigerator temperature, or other information pertaining to the refrigerator, when refrigerator controls 720 are being used. Display 710 can show sound information such as, for example, on or off, source, volume, balance, trouble, bass, etc., when sound controls 730 are being used. Control section 700 can also provide controls for other devices either integral to table 10 or external to table 10. For example, control section 700 can control an infrared, radio frequency, or other transmitter in table 10 that sends signals to lighting dimmers, window blinds, televisions, audio system components, door locks, or any other device that can be controlled. The control section 700 may thus be operably coupled to a programmable logic circuit (PLC) or controller in the table, which may be similar to the controller defined by programmable microprocessor 2000 further described elsewhere herein. Details of the microprocessor 2000 and related devices of the PLC will not be repeated here for the sake of brevity.

Table 10 also includes an input/charging station 600 that, in this case, includes USB ports 610 and other input and/or charging connections. Charging station 600 may be disposed on one of the right or left side panels 23 or 24; however, other locations may be used. USB ports 610 can be simple charging ports for devices such as phones, tablets, computers, and other electrical devices, or can be input connections for attaching a source of music or other audio to table 10, or a combination of both. Other input and/or charging connections that can be provided include, without limitation, HDMI, mini USB, micro USB, various smart phone connectors, optical connectors, RCA connectors, 3.5 mm audio connectors, or any other input or charging connection. In some embodiments, an output connector can also be included to pass an audio signal from the table to an external device such as, for example, headphones, external speakers, a storage device, or an external sound system.

Also shown in FIG. 1 is a main power receptacle 500 having two outlets 510. Main power receptacle 500 can be used to power external devices such as, for example, a hot plate, a toaster oven, a microwave oven, a fondue pot, a crockpot, a charger, lamp, or any other device that is powered by main power.

While a certain number of input and/or charging ports, outlets, and connections are shown, it is noted that any number of any type of connection can be included.

Table 10, in this example, has two audio speaker housings 410, 420 located at the rear upper corners of sides 40,50, respectively which contain speakers (e.g. drivers). FIG. 1 shows speaker housing 420 having a grille 422 that covers the speaker driver (not shown). FIG. 1 similarly shows speaker housing 410 covered by grille 412. Grilles 412, 422 may comprise perforated metal or plastic sheet material, fabricate covers, or other. Speaker housings 410, 420 can have their own integral amplifiers built into the speaker enclosures, or their drivers can be powered by amplifiers located outside of the speaker enclosures, but inside table 10. Alternatively, the drivers of speaker housings 410, 420 can be powered by amplifiers located outside of table 10. In any of these configurations, table 10 can include connections to connect either internal or external amplifiers to speaker housings 410, 420. For example, table 10 can include connections to plug external amplifiers to speaker housings 410, 420 in order to supply more power to speaker housings 410, 420 than can be provided by integral amplifiers.

Figure 4:
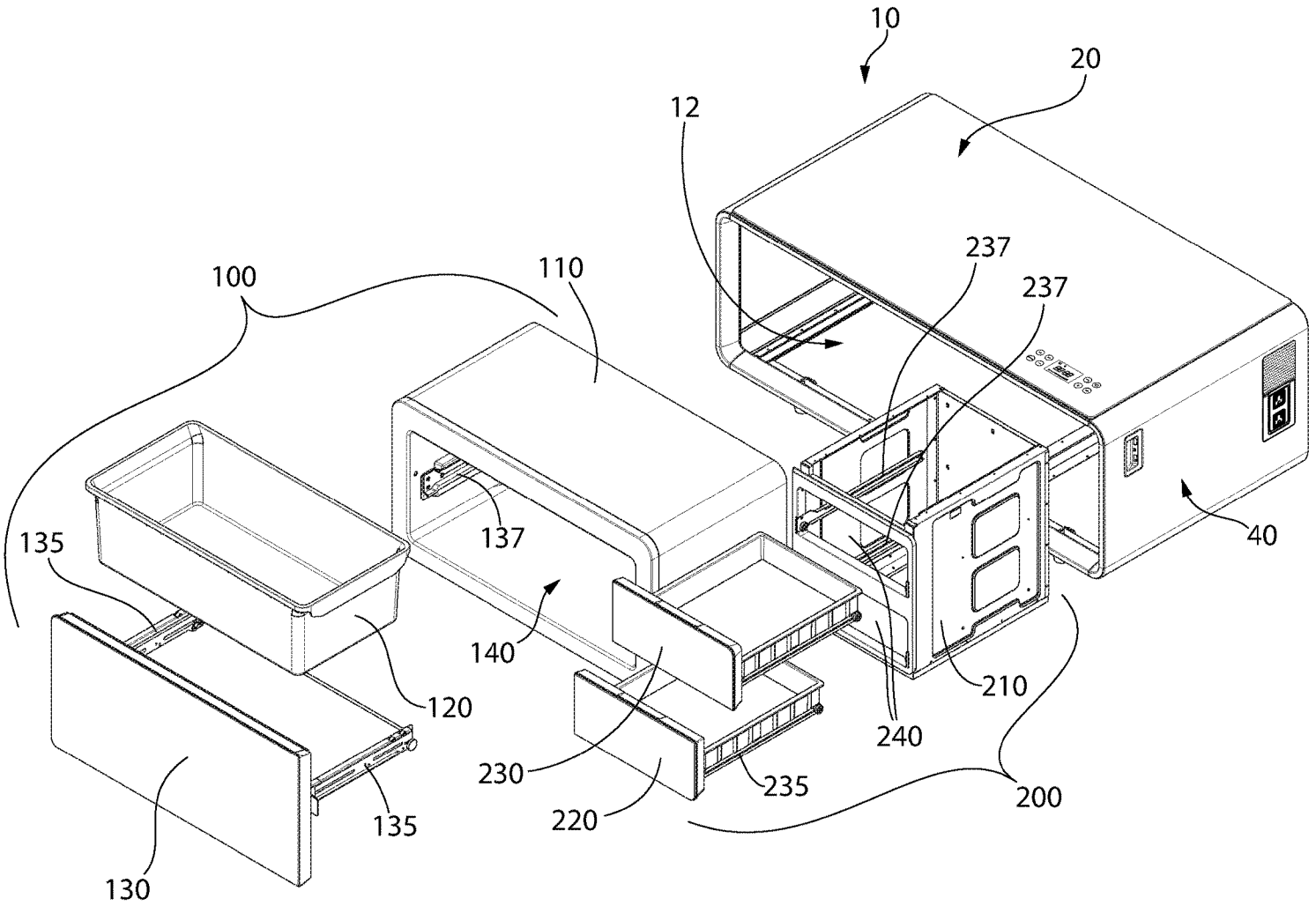
FIG. 4 is a first front perspective disassembled view of the table shown in FIG. 1.

FIG. 4 shows table 10 in more detail in an exploded view. Table 10 has primary cavity 12 in which refrigeration assembly 100 and storage assembly 200 can be located. Refrigeration assembly 100 includes a refrigeration housing 110 that is thermally insulated and forms the top, bottom, sides and rear of a refrigerated area 140. A tub 120 is supported by a drawer 130 that slides in and out of refrigerated area 140 on sliders 135/137. Beverages and food items that are to be refrigerated can be placed in tub 120 and are easily accessible when drawer 130 is pulled forward out of refrigerated area 140. In this embodiment, refrigeration assembly 100 can be installed in, and removed from, table 10 as a single unit for easy repair or replacement. Non-refrigerated storage assembly 200 includes a storage housing 210 that houses two drawers 220, 230 that are supported on sliders 235/237 within openings 240.

Figure 5:
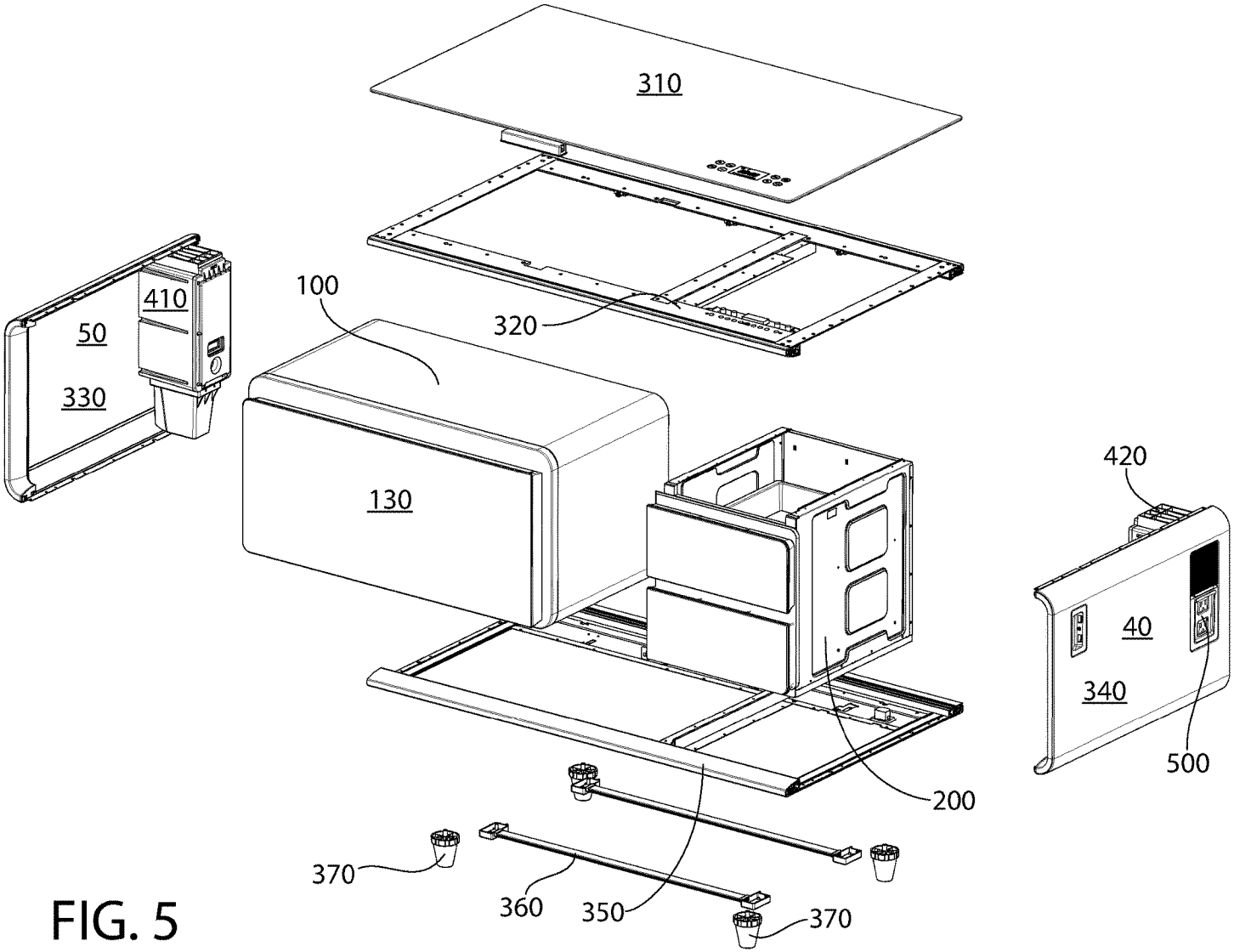
FIG. 5 is a second front perspective disassembled view of the table shown in FIG. 1.

FIG. 5 shows table 10 in detail in another exploded view. FIG. 5 shows the primary housing of table 10 as including side panels 330, 340, an upper frame 320 and a lower frame 350. An upper panel 310 is positioned above upper frame 320 and includes control section 700. Electronics associated with control section 700 can be located within control section 700 or remotely from control section 700. If the electronics associated with control section 700 are located remotely from control section 700, they can be located on or near the devices they control or they can be located at any other location in table 10. If the electronics associated with control section 700 generate a sufficient amount of heat that they benefit from cooling, the electronics can be located in the area behind refrigeration housing 110 and storage housing 210 or some other area where forced cooling is provided (described below). Lighting bars 360 provide light below table 10 for esthetic or other purposes. Lighting bars 360 can be LEDs or other types of lighting. Also, lighting bars 360 can alternatively or additionally be or include fluorescent or any other type of appropriate lighting. In this example four legs 370 are provided to support table 10 above the surface on which it rests. A different number of legs can be used to provide sufficient support for a table having a particular weight, for example, or for esthetic reasons. Different length legs can be provided if a different height above the surface is desired. If speaker housings 410, 420 produce a significant amount of bass, legs 370 having a longer or shorter length may be desirable to accentuate or suppress the bass level.

Figure 6:
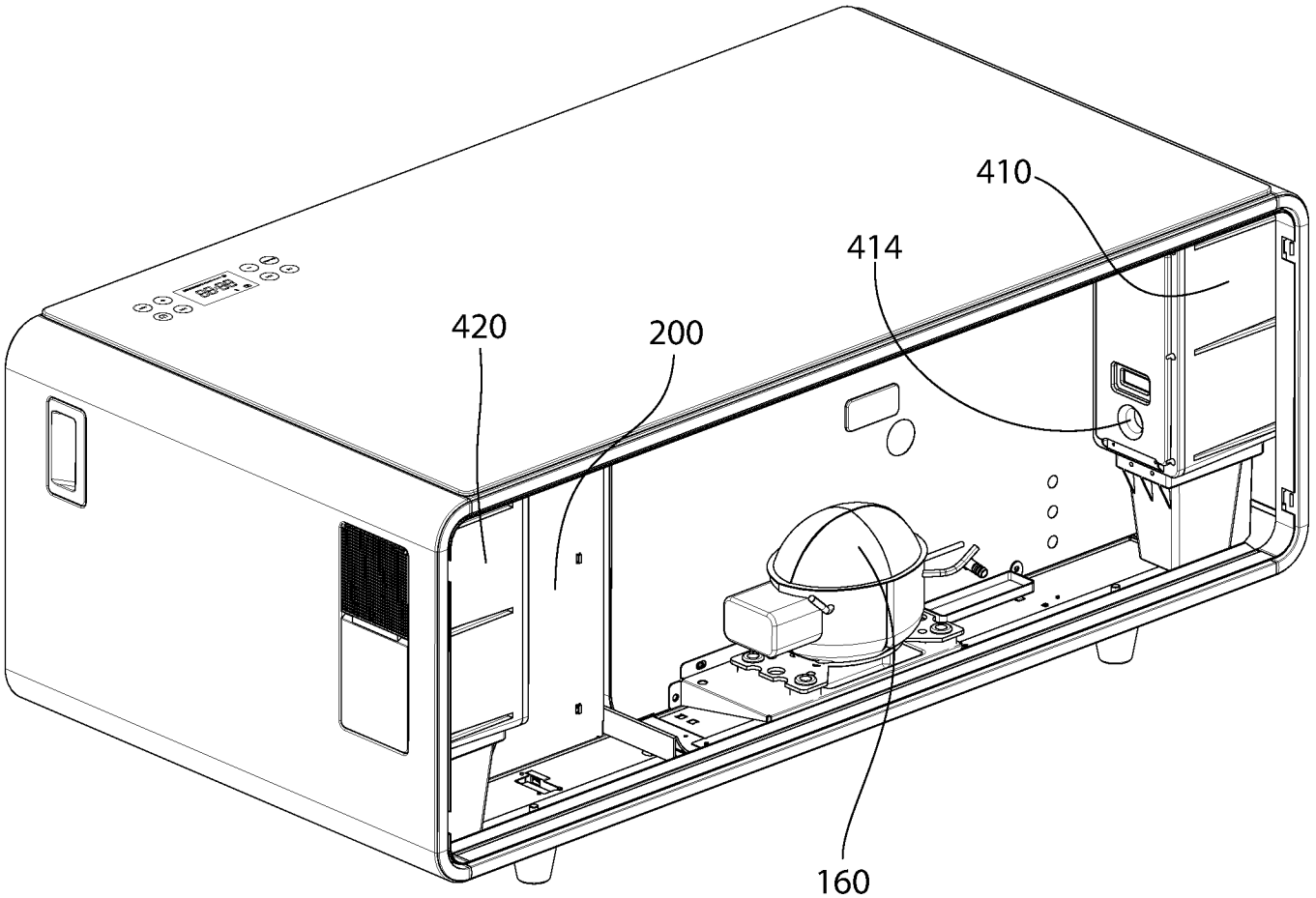
FIG. 6 is rear perspective view of the table shown in FIG. 1 with the back panel removed.
Figure 7:
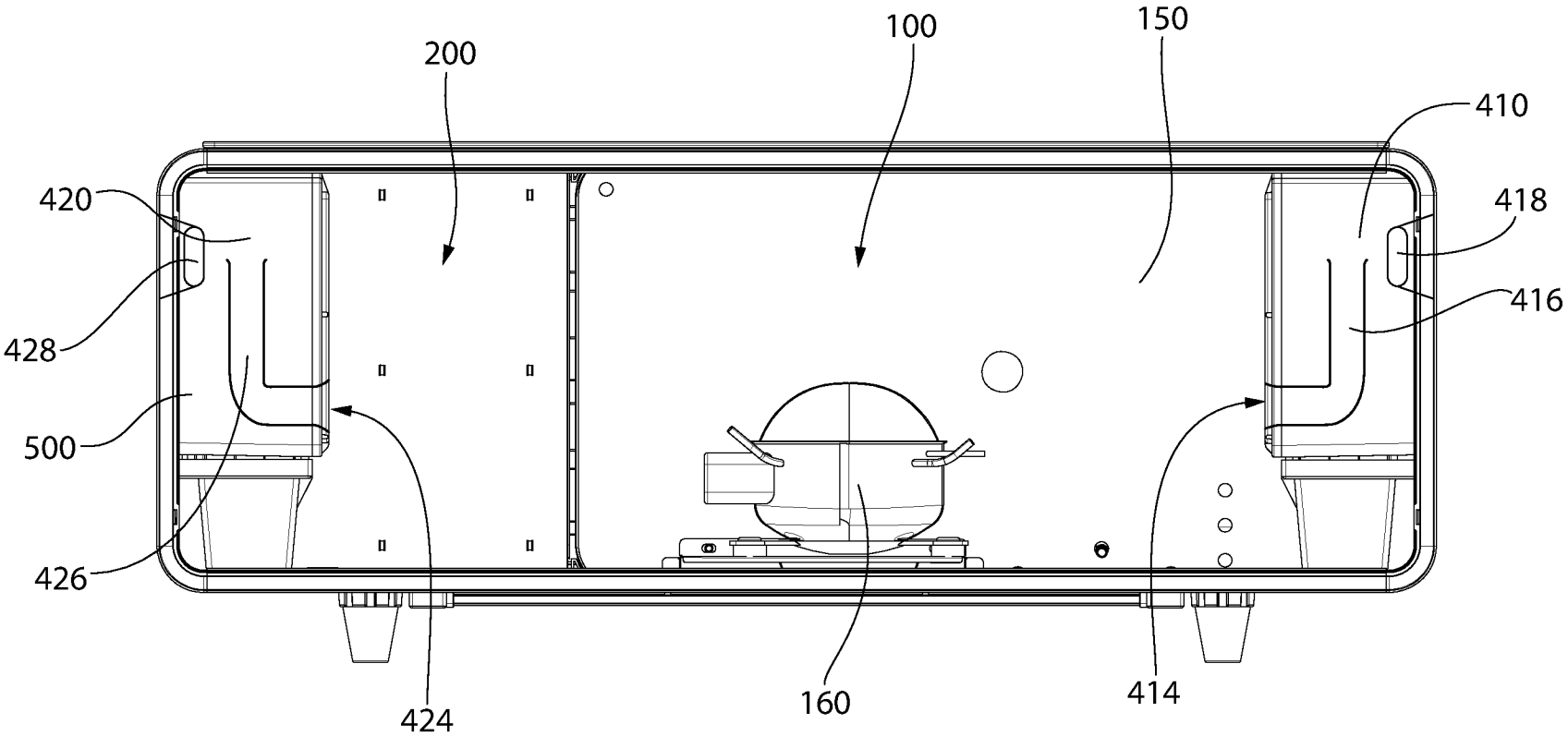
FIG. 7 a rear view of the table shown in FIG. 1 with the back panel removed.

Speaker housings 410, 420 are shown in more detail in FIGS. 5-7. In this embodiment, speaker housing 410 is mounted to side panel 330 and speaker housing 420 is mounted to side panel 340. FIGS. 6 and 7 show the relationship of speaker housings 410, 420 in an assembled state. In this example, speaker housing 410 has an air port 414 that allows air to be pushed by driver 418 through a resonator tube 416 and out of speaker housing 410 so that, among other things, driver 418 is subjected to the appropriate amount our back pressure when driver 418 moves during sound production. Resonator tube 416 can also act as a reverberation, or other, chamber to modify the sound projected by speaker housing 410. Similarly, speaker housing 420 has an air port 424 that allows air to be pushed by driver 428 through a resonator tube 426 and out of speaker housing 420 so that driver 428 is subjected to the appropriate amount our back pressure when driver 428 moves during sound production. Resonator tube 426 can also act as a reverberation, or other, chamber to modify the sound projected by speaker housing 420. More or no air ports and/or resonator tubes can be used or air ports and/or resonator tubes of a different size or shape can be used in particular embodiments. A columnar insert below each of speaker housings 410, 420. The columnar inserts can provide structural support for table 10 in order to better bear loads such as someone sitting on the rear edge of table 10. Also, the columnar supports can act as reverberation chambers for speaker housings 410, 420.

FIG. 7 shows a view from the back side of table 10 with the rear cover removed. A rear panel of storage housing 200 can be seen as well as a back wall 150 of refrigeration housing 100. In this example, refrigeration housing 100 includes a compressor 160 as well as other mechanical equipment in order to produce the refrigeration needed. Compressor 160 produces heat as heat is removed from the air inside refrigerated area 140. It can be advantageous to remove this heat to allow the refrigeration equipment to operate as designed. As drivers 418, 428 move to produce sound, air is moved in and out of air ports 414, 424. This air movement can cause otherwise stagnant air around compressor 160 to move and, as a result, increase the cooling of compressor 160.

Figure 8:
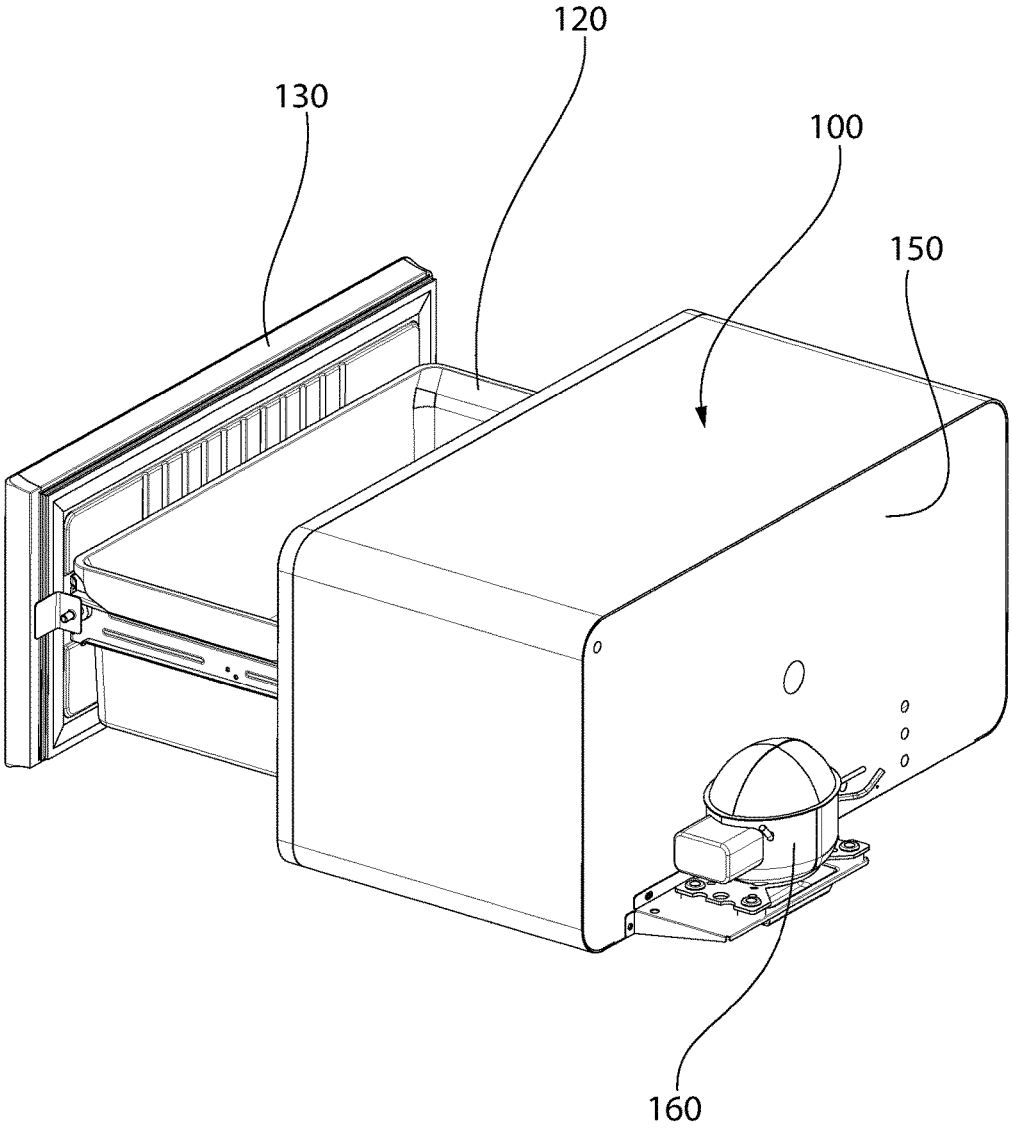
FIG. 8 is a rear perspective view of an example of a refrigeration housing of the table shown in FIG. 1.

FIG. 8 is a perspective view of the back of refrigeration housing 100 showing one possible placement of compressor 160 on back wall 150 of refrigeration housing 100. Compressor 160 can be located in other locations either on, or removed from, back wall 150. In one embodiment, compressor 160 may be configured and operable to cool contents of refrigerated drawer 1130 to a range of about and including 53-68 degrees F. (Fahrenheit) as one non-limiting example via thermoelectric cooling.

Figure 9:
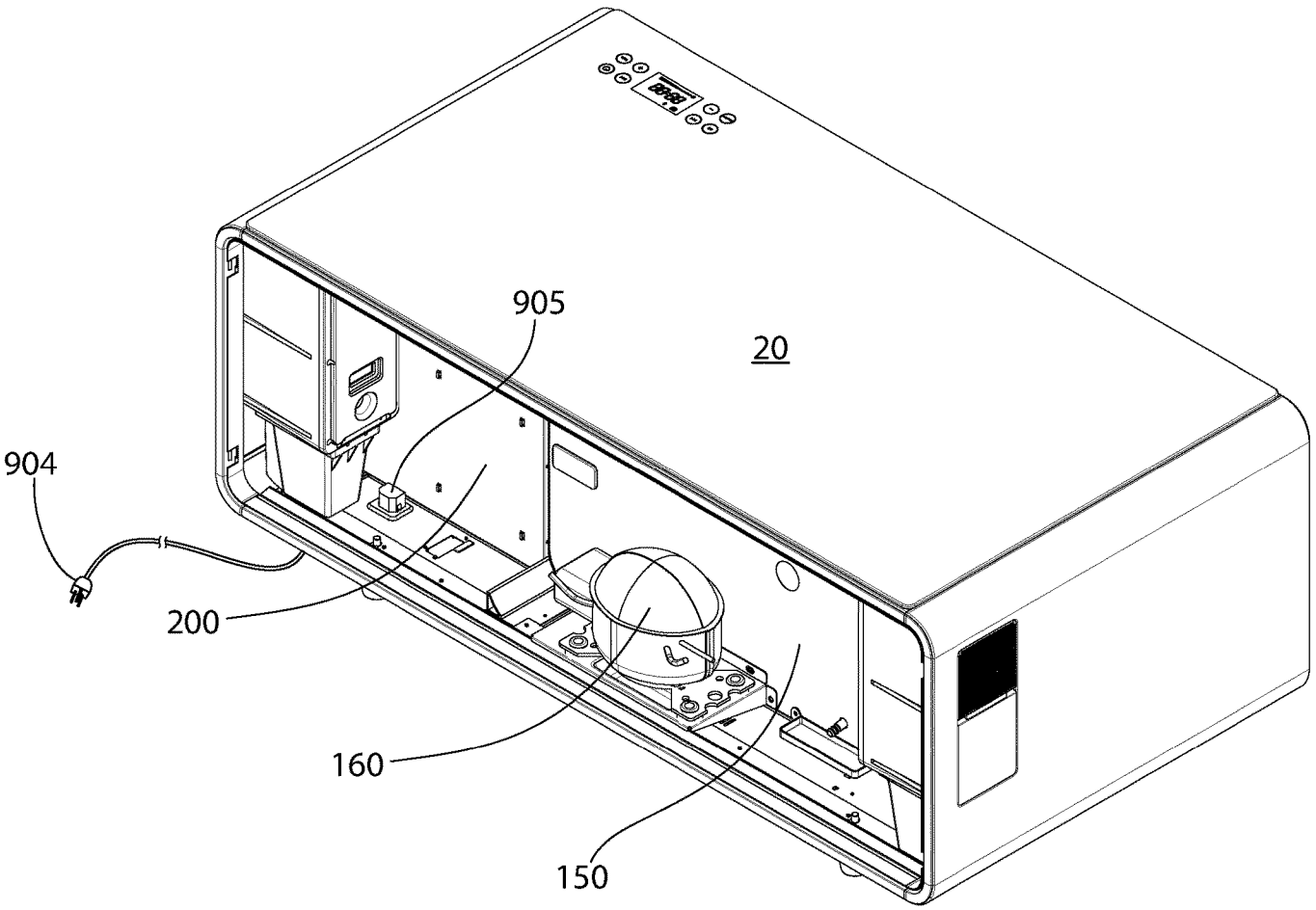
FIG. 9 a rear perspective view of the table shown in FIG. 1 with the back panel removed.
Figure 10:
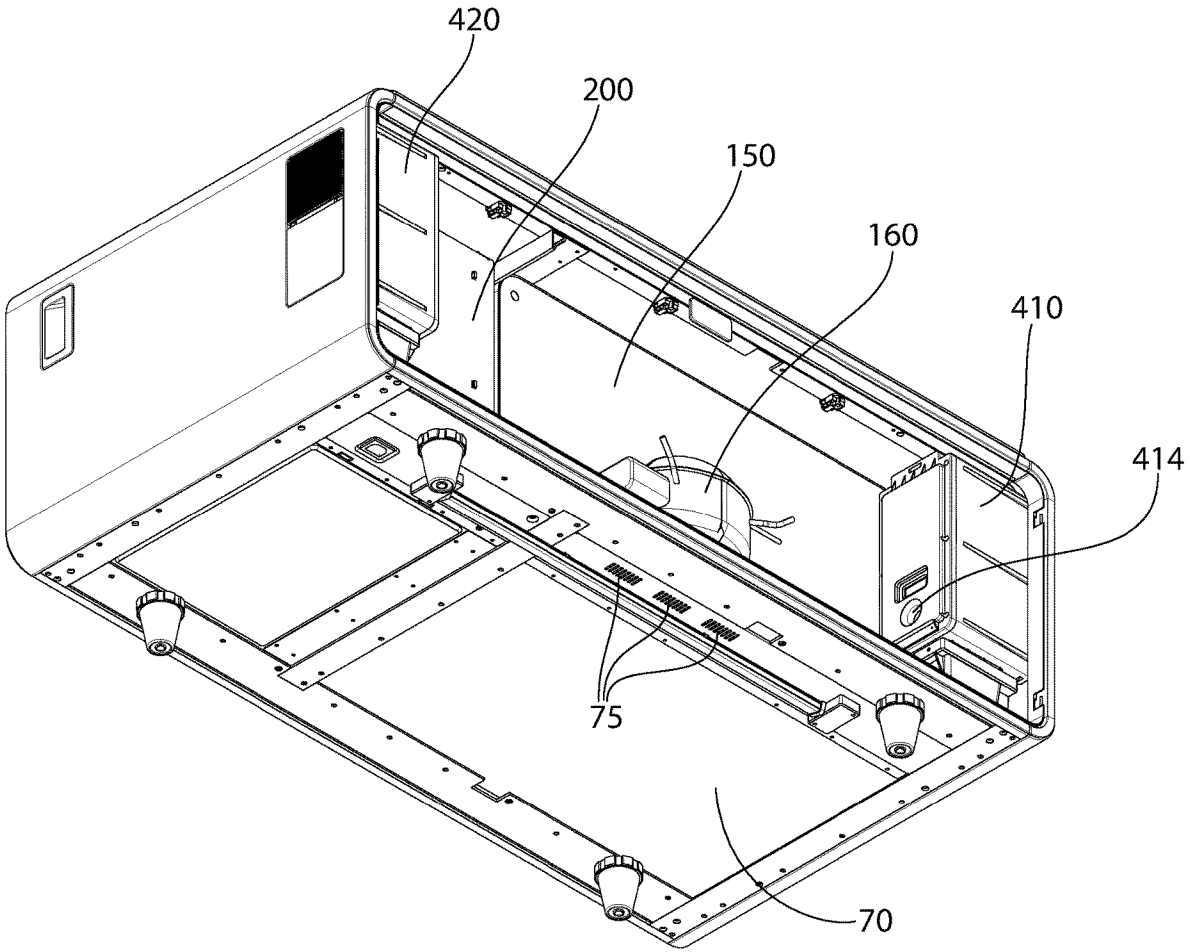
FIG. 10 is rear perspective view of the table shown in FIG. 1 with the back panel removed.

FIGS. 9 and 10 show the rear of table 10 with the back panel removed and illustrate the relative locations of compressor 160 and air ports 414, 424 of speakers housings 410, 420 each including at least one speaker operable to produce sound. These views illustrate how air moved in and out of air ports 414, 424 can cause air to move around compressor 160.

It is noted that table 10 can have a power cord 902 that plugs into a power socket 905 on one end and at the other end to an available 120V building electrical power receptacle, thereby providing electric power for a main power supply or bus (not shown) of the table 10 (see, e.g. FIG. 9). The power bus is hardwired to and provides power to electrical devices such as refrigeration housing 100, speakers, lighting, and the various power outlets and ports integrated into the table which require a source of electric power. Other examples of table 10 may be battery powered and either do not have a power cord, or have a power cord that is only plugged into the building power receptacle to charge batteries located either in or adjacent to table 10.

FIGS. 6 and 7 show a compressor chamber defined by the back wall 150 of refrigeration housing 100, the rear panel of storage housing 200, speaker housings 410, 420, a portion of lower frame 350, a portion of upper frame 320, and the rear panel (not shown in these views) of table 10. Compressor 160 resides in this compressor chamber and is surrounded by the air in the compressor chamber. As discussed above, air movement in the compressor chamber can be important to provide proper heat transfer from compressor 160. This air movement can be achieved by, for example, air being moved by drivers 418, 428 and/or air passing through the various ventilation openings discussed above or other ventilation openings.

Figure 11:
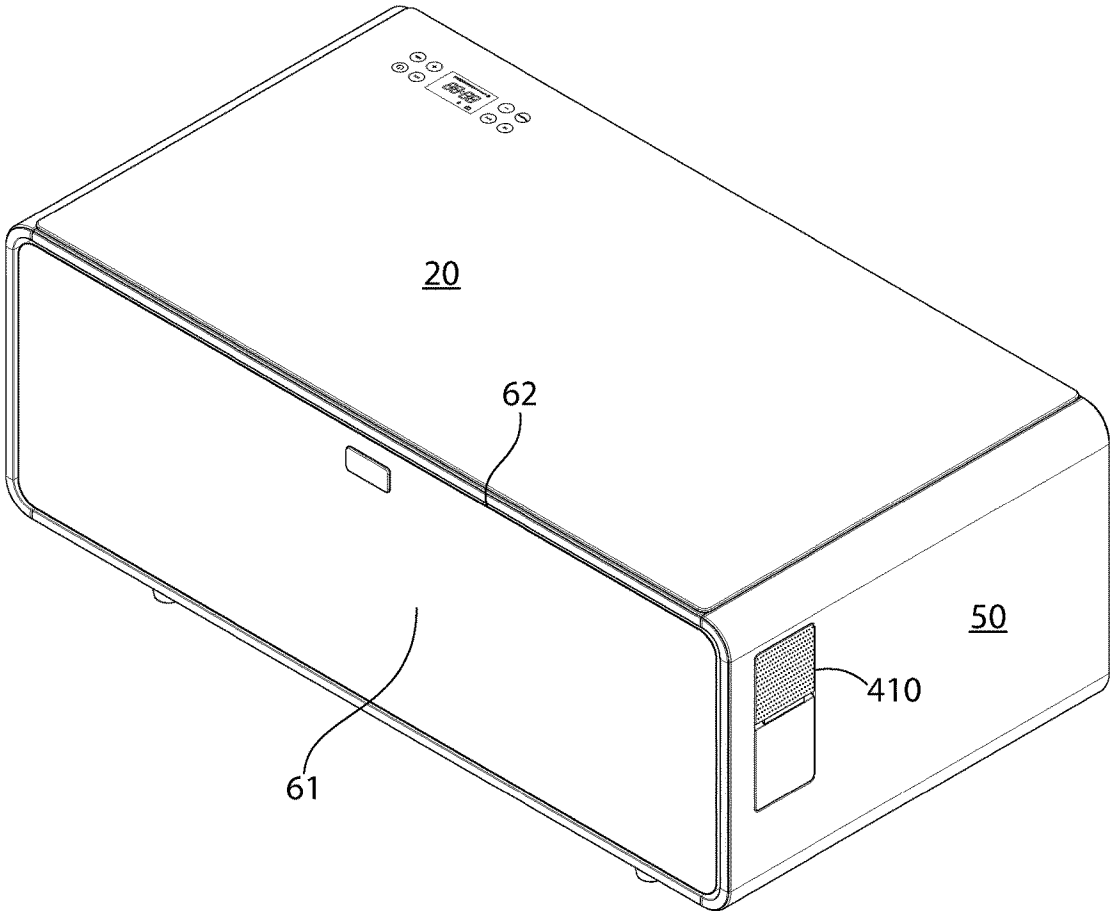
FIG. 11 is a rear perspective view of the table shown in FIG. 1 with an alternate back panel.
Figure 12:
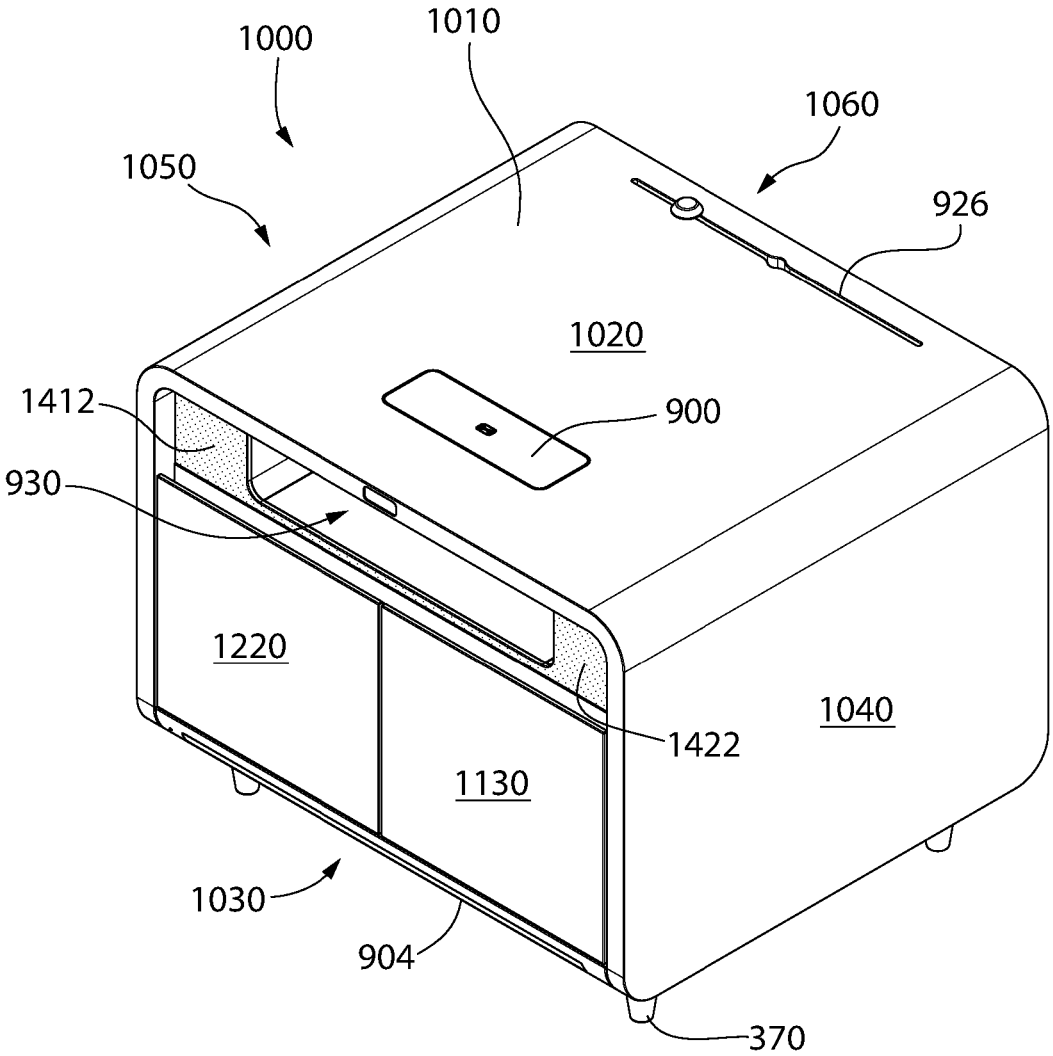
FIG. 12 is a front perspective view of a second embodiment of a multi-function table according to the present disclosure.
Figure 13:
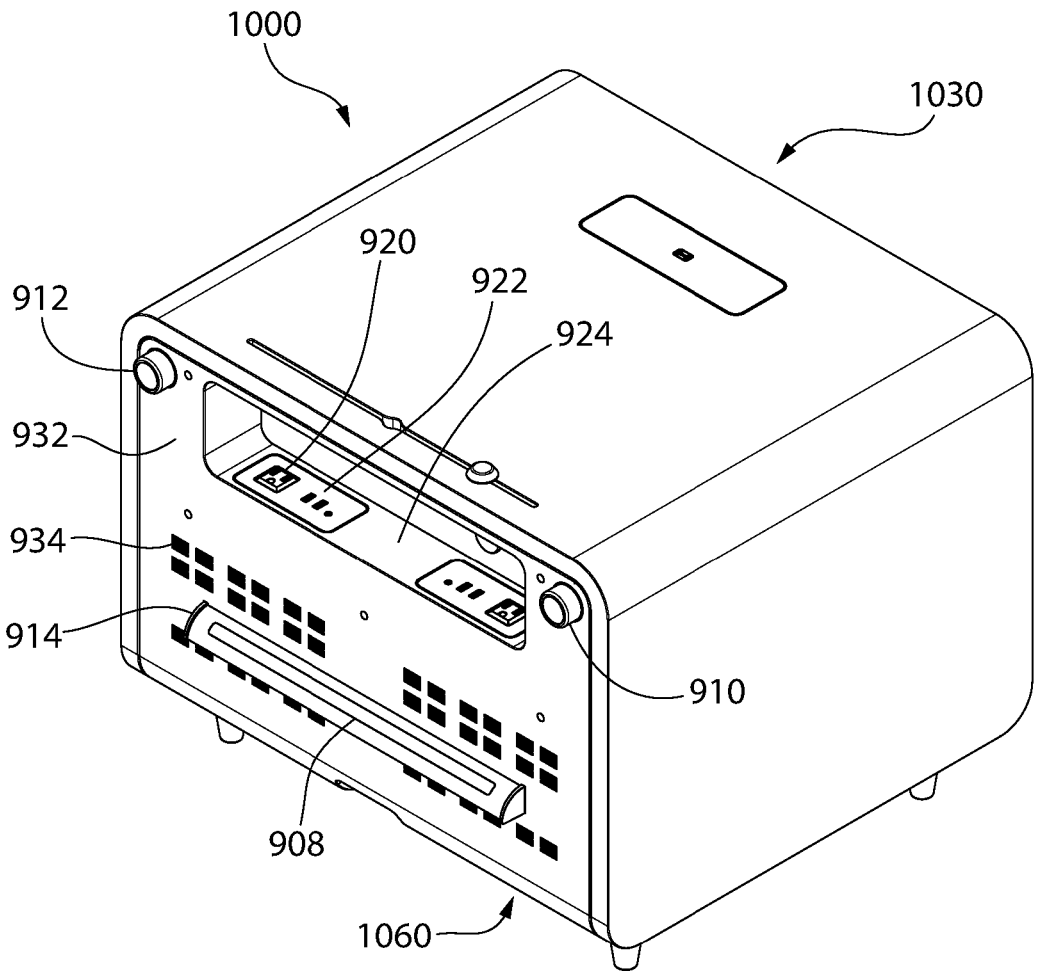
FIG. 13 is a rear perspective view of the table shown in FIG. 12.
Figure 14:
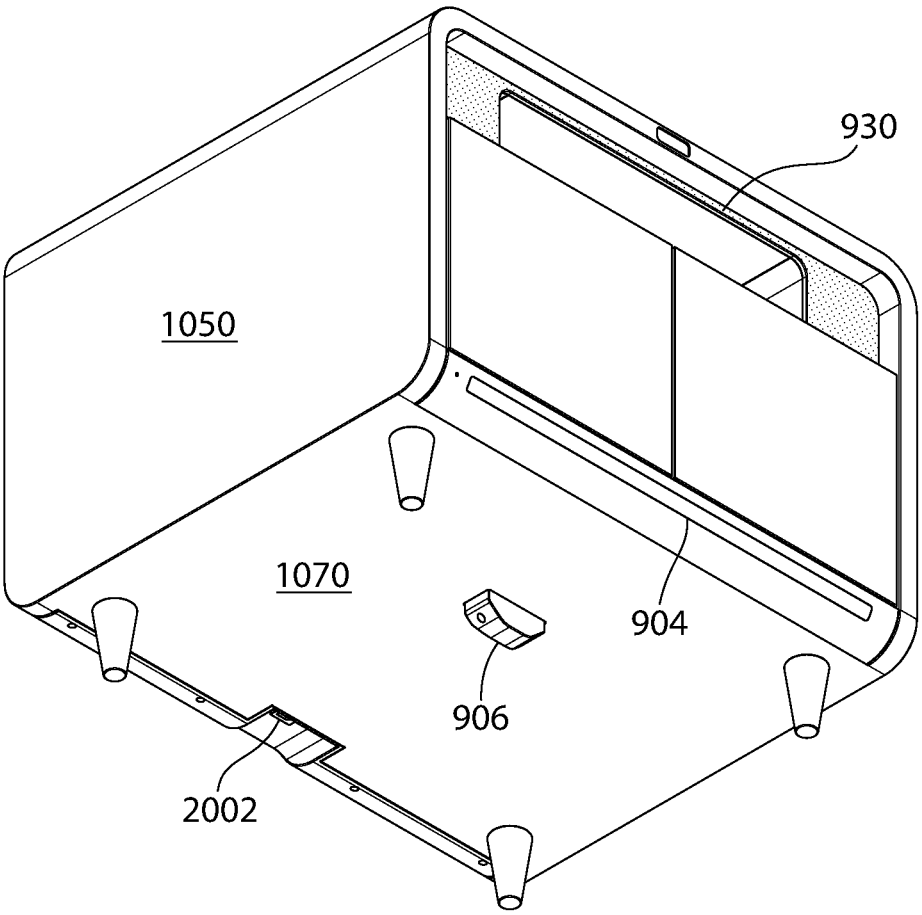
FIG. 14 is a bottom perspective view of the table shown in FIG. 12.
Figure 15:
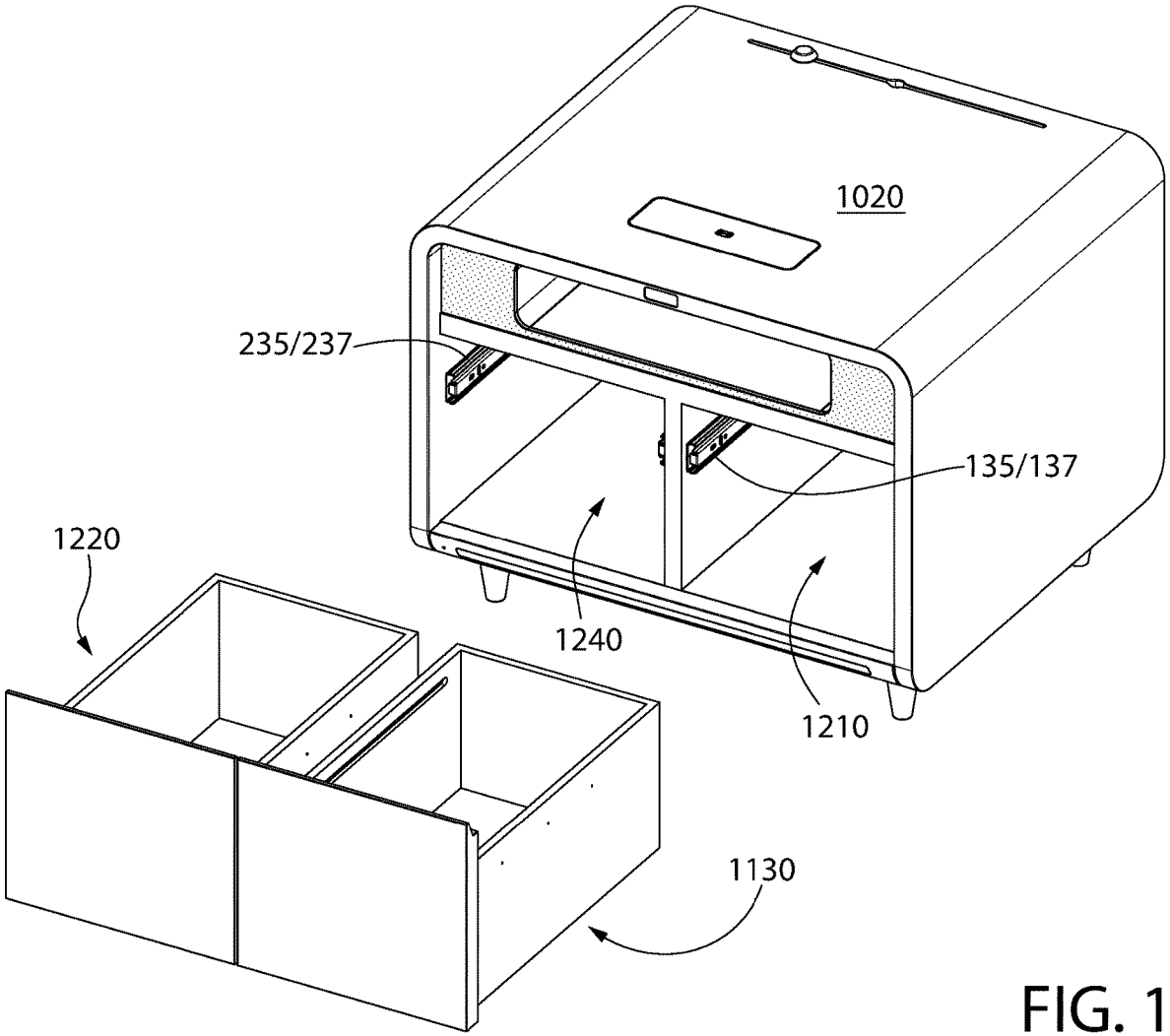
FIG. 15 is a front perspective disassembled view of the table shown in FIG. 12.

FIG. 11 shows an alternate example of a back panel of table 10. In this example, a panel 61 is surrounded by a gap 62 that allows air to pass in and out of the space in which compressor 160 is located. Gap 62 can provide or assist in providing sufficient air flow to properly cool compressor 160 and/or other equipment that may require cooling. In this example, gap 62 is configured to have a similar appearance to the gap around the drawers on the front side of table 10, while simultaneously providing air flow.

FIGS. 12-19 illustrate an embodiment of a furniture unit in the form of a smart side table 1000. Side table 1000 may be used as a nightstand and embodiments can include features geared toward such usage. Side table 1000 may share many similar construction details and features with coffee table 10 already described herein. Accordingly, the present side table will be described with brevity to avoid repetition. Particular aspects which distinguish side table 1000 from coffee table 10 will be noted.

Esthetically, side table 1000 may be similar in contour, profile, and configuration to coffee table 10 to form a coordinated set when paired with table 10. Side table 1000 however is smaller in at least length than coffee table 10 making it more amenable to function as a side table or night stand. Side table 1000 may therefore have a length less than twice the height of the front side 1030.

Side table 1000 has a primary housing or base comprising a plurality of panels including top panel 2021, bottom panel 2022, right side panel 2023, left side panel 2024, and removable rear panel 1932 which define a forwardly open primary cavity 2030. The cavity 2030 may divided by a vertical division wall 2031 into a refrigerated opening 1210 and non-refrigerated opening 1240. The plurality of panels define a top 1010 defining a horizontal top or upper surface 1020, a front side 1030, a right side 1040, a left side 1050, a rear side 1060 and a bottom 1070. Table 1000 has a rectangular parallelpiped or cuboid configuration in one non-limiting embodiment. This example is a table with a horizontal rectangular upper surface, a horizontal rectangular bottom, and vertical rectangular front, back and sides. Adjoining corner regions between these may be rounded in one embodiment as shown similarly to table 10. Other embodiments of the invention however can have a different number of sides, use shapes other than rectangles, and use angles other than 90°. In this example, upper surface 1020 is flat and covers substantially all of the entirety of the table from side to side and front to rear. A plurality of legs 370 elevates the side table 1000 above the floor similarly to table 10.

Figure 17:
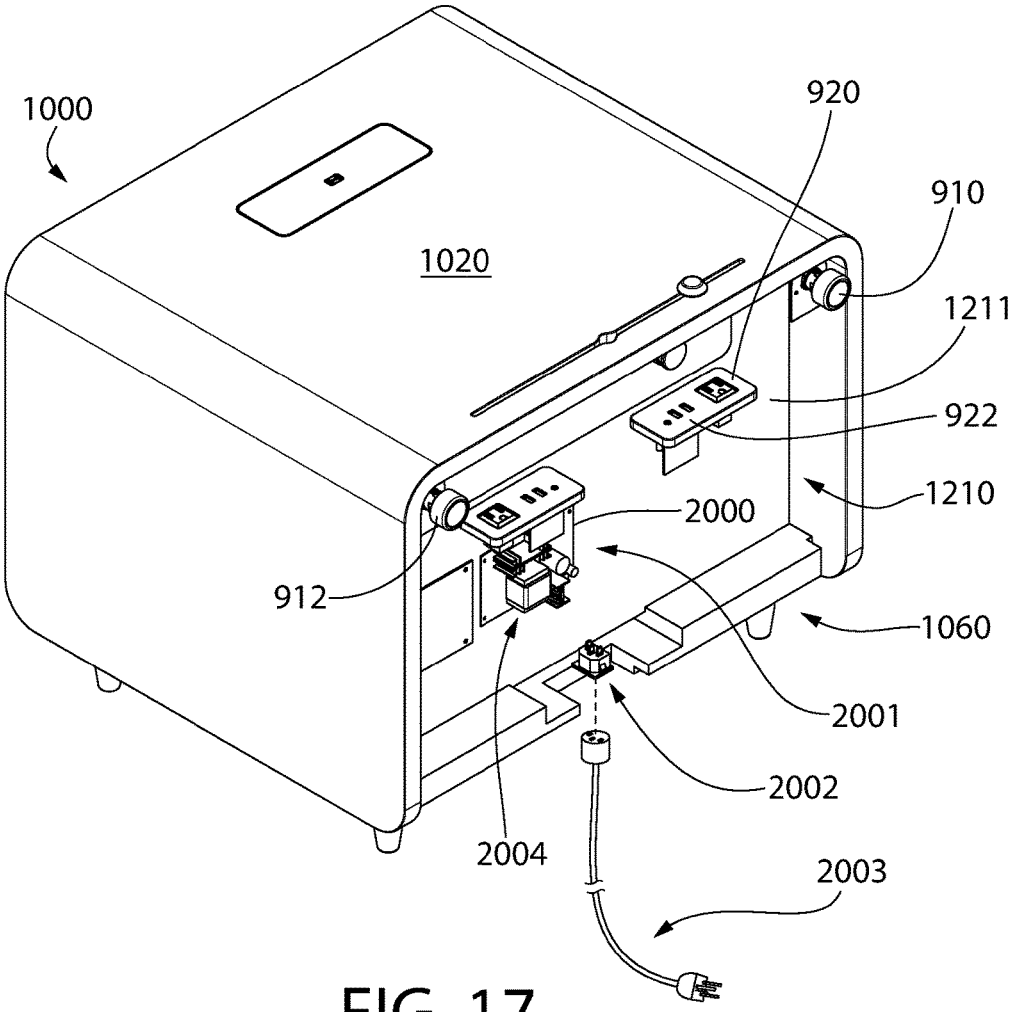
FIG. 17 is rear perspective view of the table shown in FIG. 12 with the back panel removed.
Figure 18:
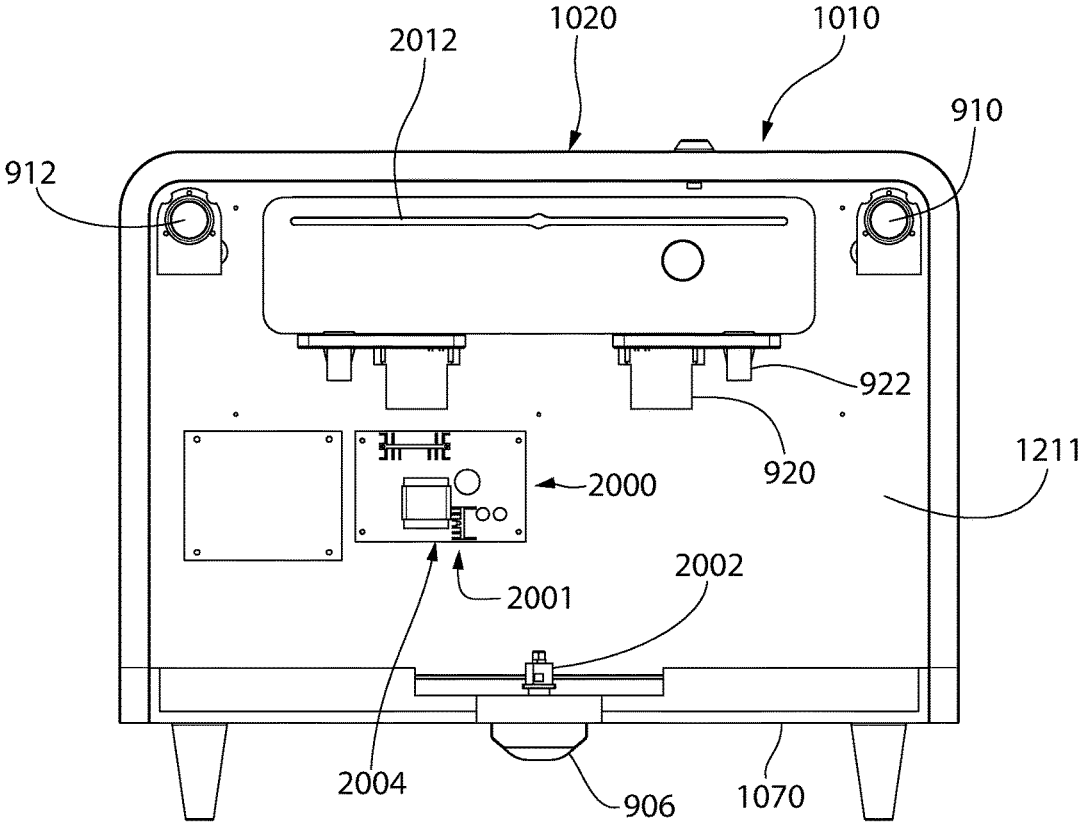
FIG. 18 a rear view of the table shown in FIG. 12 with the back panel removed.
Figure 19:
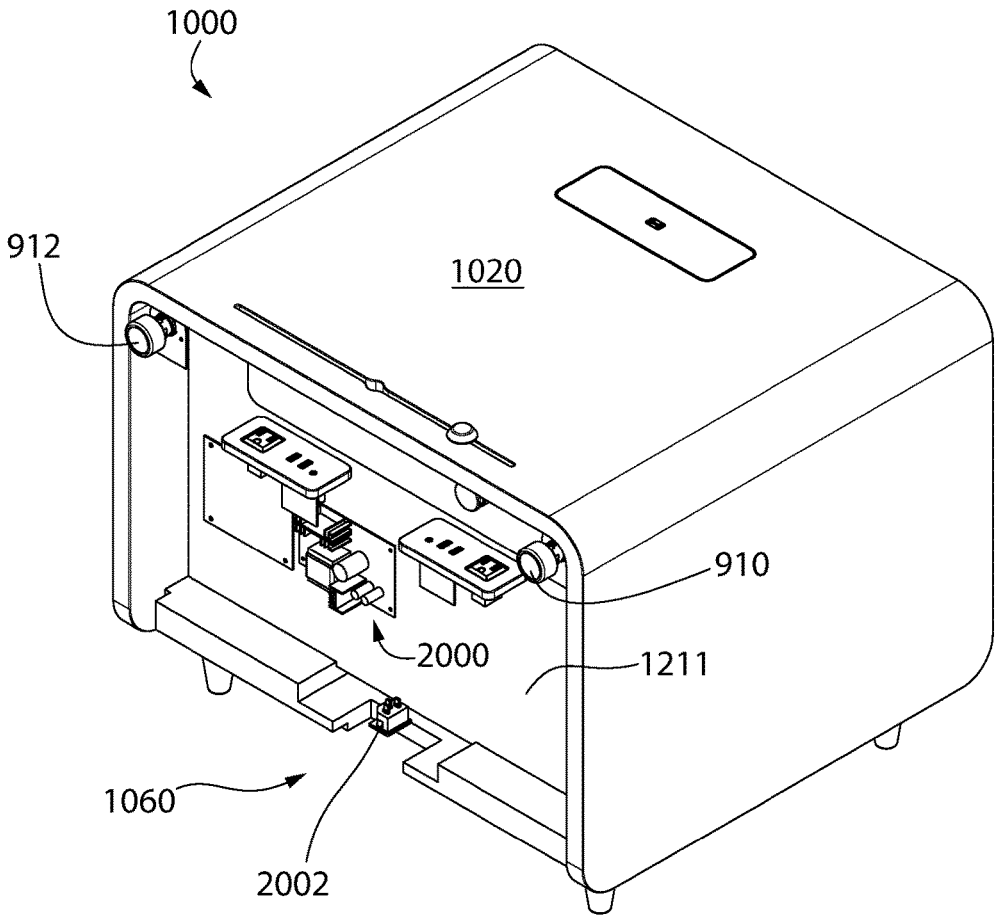
FIG. 19 is a second rear perspective view of the table shown in FIG. 12.

A removable rear panel 1932 may be provided on rear side 1060 of side table 1000. Rear panel 1932 conceals the refrigeration unit assembly 100 and its compressor 160 arranged at the rear side of the table 1000 in a manner similar to that already shown in FIG. 6 for table 10. The compressor 160 is not shown in FIGS. 17-19 for clarity. Since side table 1000 is designed for ordinary placement along a wall as opposed to coffee table 10, a plurality of cooling openings 934 may be formed in the rear panel 1932 for inducing airflow into compartment 2010 formed between a rear internal wall 1211 of the table 1000 and rear panel 932 and cooling the compressor housed therein when the rear panel is attached to the table. In one embodiment, the power outlets 920, USB ports 922, PCB with controller 2000, and other devices may be mounted to the inner wall 1211 as best shown in FIG. 17.

Similarly to table 10, side table 1000 includes refrigeration unit or assembly 100 and non-refrigerated storage unit or assembly 200 with access to the user via openings from the front side 1030. These units may be arranged side by side similarly to table 10. In this example, refrigeration assembly 100 may be accessed by a single sliding drawer 1130 manually movable by the user into and out of the refrigerated opening 1210 in table 1000 via sliders 135/137. A smaller internal drawer 2008 may be provided which is nested inside drawer 1130 for organizing storage of refrigerated items in drawer 1130. Drawer 1130 is configured for holding multiple refrigerated items (e.g. beverage containers, snacks, food, etc.). The drawer 1130 is cooled by compressor 160 (see, e.g. FIG. 16) mounted at the rear of the table 1000 in a manner similar to refrigerated drawer 130.

Non-refrigerated storage assembly 200 includes a single sliding drawer 1220 in this case supported on sliders 235/237 within a non-refrigerated opening 1240. Construction and details of refrigeration assembly 100 and non-refrigerated storage assemblies 200 were previously described herein. Other embodiments of side table 1000 may have different numbers of drawers and/or pivoting doors instead of drawers, or a combination of the two.

Side table 1000 may further include a frontally open storage compartment 930 disposed between the upper surface 1020 and drawers 1130 and 1220. This provides ready-access storage for any of numerous items, such as books, magazines, personal electronic devices 2060 (see, e.g. FIG. 20), etc.

Side table 1000 further includes a wireless charging pad 900 integrated into the upper surface 1020 of the table for recharging electronic devices such as cell phones, watches, etc. Charging pad 900 comprises associated electrical/electronic circuity coupled to a power supply for forming a fully functional wireless charging station. This technology is commercially available and it is well within the ambit of those skilled in the art to provide a wireless charging pad without further elaboration.

Side table 1000 further includes a motion-activated front light bar such as LED (light emitting diode) strip 904 disposed near the bottom of the front side 1020. A motion sensor 906, which may be disposed on the bottom 1070 of side table 1000, is configured to detect motion in front of the table and activate the LED strip 904 when a user passes near the front side 1030 of the table. In one embodiment, sensor 906 may be configured for detecting motion in a 35-45° angle and 3 meter circumference as a non-limiting example. Sensor 906 is operably and communicably coupled to LED strip 904. Control circuitry associated with the LED strip 904 may include a timer circuit to terminate power to the strip and light emission after a preprogrammed period of time if no further motion is detected in the interim by motion sensor 906. The timing may be controlled by programmable controller 2000 via a software application ("app") running on a user's personal electronic device 2060.

Additional lighting provided with side table 1000 may include a rear light bar such as LED strip 908 disposed on the rear side 1060 of the table. LED strip 908 and associated circuitry may be configured to provide accent or ambience lighting in one embodiment which is variable in intensity and color. The LED strip 908 is operable to change between a plurality of user-selectable colors of the visible spectrum (e.g. red, orange, yellow, green, blue, indigo, and violet) via a rotatable lighting control knob 910 mounted on rear side 1060. Alternatively, the rear lighting may be remotely controlled via a software application ("app") running on an external personal electronic device (e.g. cell phone, pad, tablet, etc.) wirelessly communicating with the lighting system via a wireless interface. The intensity (i.e. visible level) of lighting may be controlled via the lighting control knob 910 or the software app. In one embodiment, the rear LED strip 908 may be integrated into a semi-circular support hood 914 extending for at least the length of the LED strip, and preferably longer as shown. Hood 914 is configured to direct light emitted by LED strip 908 rearward and upwards at an angle to vertical for producing the ambience lighting effect which shines on building wall adjacent to the rear of side table 1000. The wall acts as a display surface for the lighting effects.

In one embodiment, the rear LED strip 908 and associated circuitry may be configured to selectively simulate a sunrise for use of side table 1000 as a nightstand. The intensity of light generated by the LED strip 908 may gradually increase over time during a wake-up lighting sequence. The circuitry may be configured and preprogrammed via the software app running on the external personal electronic device 2060 to initiate the LED strip 908 lighting at a user preselected wake-up time.

Side table 1000 further includes audio speakers similarly to coffee table 10 already described herein, albeit the present speaker housings 1410, 1420 may configured and arranged differently on the table. As shown in the figures, speaker housings 1410, 1420 are disposed on right and left sides of the table 1000 and may extend for substantially the entire front to rear depth of the table for improved bass response. The speaker drivers 1418, 1428 are disposed on the front side 1030 of table 1000 to project sound in a forward direction from the table 1000. Each speaker housing 1410, 1420 includes a speaker cover grille 1412, 1422 in a similar manner to table 10 to conceal and protect the drivers. In lieu of separate speaker cover grilles, they may be combined into a single grille which covers both speaker drivers 1418, 1428 as shown. A speaker knob 912 may be disposed on the rear side 1060 of table 1000 is operably coupled to audio circuitry in the table to control the volume of sound produced by the speakers.

Figure 16:
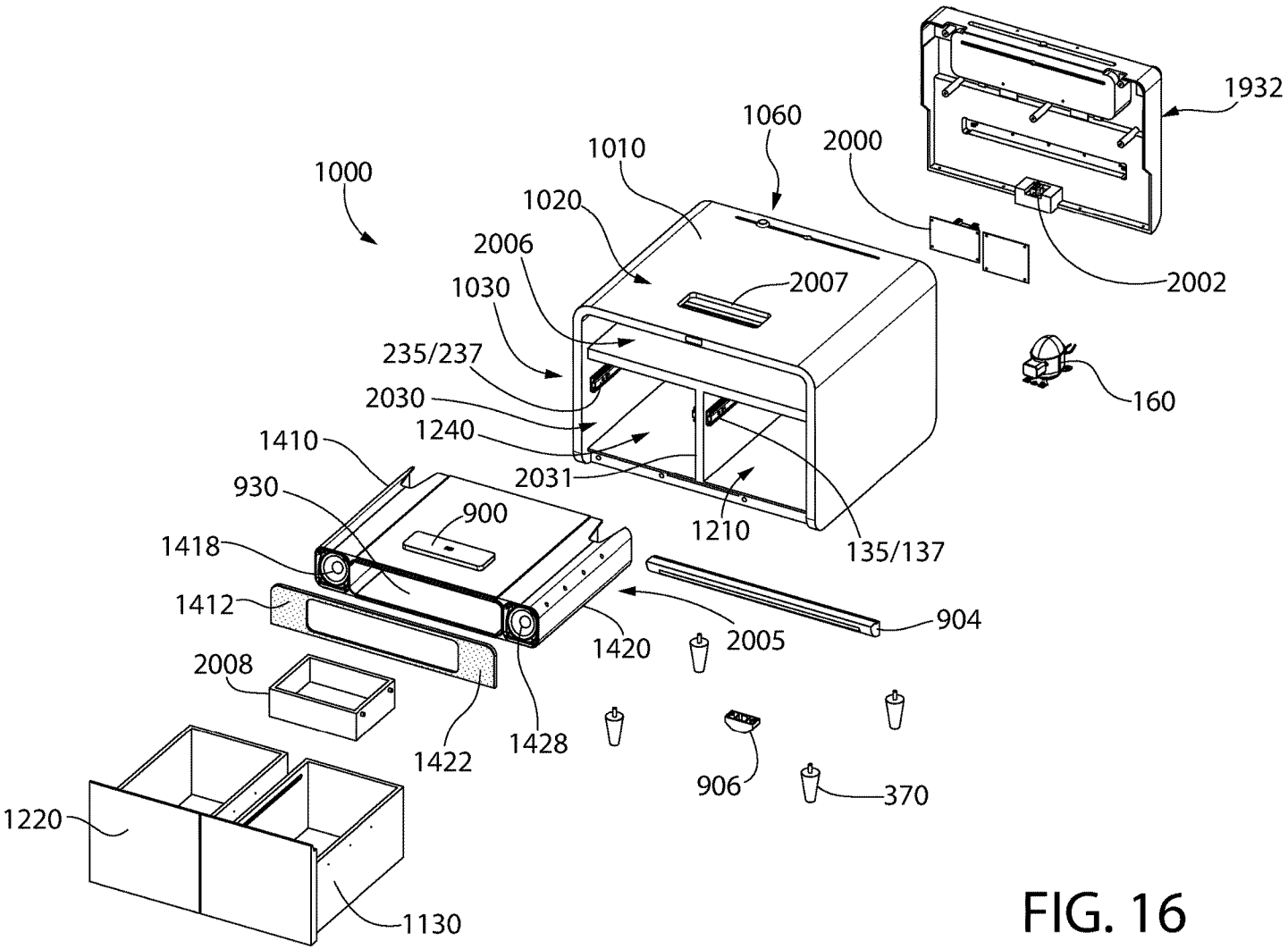
FIG. 16 is a front perspective exploded view of the table shown in FIG. 12.

In one embodiment, the speaker housings 1410, 1420, wireless charging pad 900, and frontally open storage compartment 930 may be incorporated into a single insertable and removable speaker insert 2005 shown in FIG. 16. The speaker insert 2005 advantageously simplifies construction and speeds assembly of the side table 1000. Speaker insert 2005 is configured for insertion into a frontally open receptacle 2006 formed in table 1000 above the drawers. The top surface 1020 of side table 1000 contains an opening 2007 configured for receiving the wireless charging pad 900 on the housing insert 2005 therein.

Figure 20:
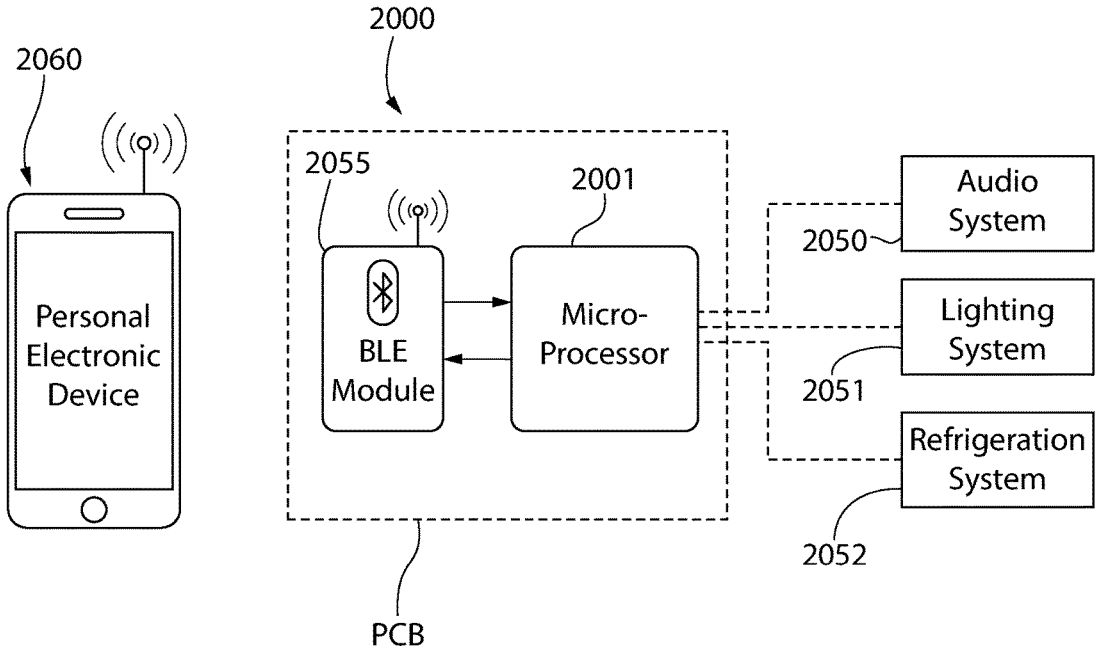
FIG. 20 is a schematic diagram of one embodiment of the control system of the table showing a microprocessor and wireless communication links for connection to a personal electronic device.

With additional reference to FIG. 20 showing the table control system, the lighting system 2051 (comprising the foregoing front light bar 904 and rear light bar 908), audio system 2050 (comprising the foregoing speaker drivers 1418, 1428), refrigeration system 2052 (comprising compressor 160, etc.), and other electric/electronic features of the table 1000 may be controlled by a printed circuit board (PCB) comprising a programmable microprocessor 2001 which defines a programmable controller 2000. These systems and features are operably and communicably coupled to the controller 2000 via wired and/or wireless communication links or pathways formed within the table. Besides microprocessor 2001, the PCB includes all usual ancillary electronic devices necessary for forming a fully functional programmable controller which may include for example without limitation volatile and non-volatile memory, non-transitory tangible computer-readable medium for storing data and control logic or program instructions (software) executed by the microprocessor 22001, wired and wireless communication interfaces or ports, sound card, a power supply, etc. Microprocessor 2001 can communicate wirelessly such as via Bluetooth (see, e.g. Bluetooth module 2055 on PCB), Wi-Fi, NRC, etc. with a user's external personal electronic device 2060 (e.g. cell phone, pad, tablet, etc.) via the communication interface for programming and controlling the microprocessor, and updating firmware executed by the microprocessor 2001. Microprocessor 2001 may be programmed and configured to execute the control logic instructions which may direct and control operation of the lighting system, audio system, refrigeration unit, and other appurtenances disclosed herein so that these systems and devices perform in the manner described.

In one embodiment, the programmable controller 2000 may further include circuitry and devices configured for providing a white noise generator. The white noise, which may comprise several user selectable sounds, are played through the audio system and speaker drivers 1418, 1428 for use when a user sleeps or simply relaxes or meditates.

Side table 1000 further includes a plurality of 120V electrical outlets 920 and USB ports 922 similarly to table 10. In one embodiment, the outlets and ports may be arranged within an elongated rearwardly open cavity 2014 formed in removable rear panel 932 which defines a connectivity station 924 arranged at the rear side 1060 of table 1000. This allows devices requiring either a 120V device (e.g. lamp, charging block, clock, etc.) or USB connection for an external electronic device (e.g. cell phone, notebook, pad device, etc.) for charging and/or direct connectively interface to be accommodated and powered by the table 1000. In one embodiment, an elongated cord pass-through slot 926 may be formed through the top 1010 and upper surface 1020 of side table 1000 to provide cord management and connection to external electronic devices which might be placed on the upper surface 1020 of the table. An elongated upper pass-through slot 926 is disposed in the top 1010 proximate to the rear end of the table upper surface 1020 and extends horizontally between the right and left sides 1040, 1050 of side table 1000. In addition, a second elongated lower pass-through slot 2012 is disposed within rear cavity 2014 of the table 1000 which extends forward through rear inner wall 1211 into the storage compartment 930 beneath the table upper surface 1020. This allows connection to external personal electronic device (e.g. cell phone, pad, tablet, etc.) which might be placed inside the storage compartment 930.

The rear side 1060 of side table 1000 may include a power socket 2002 for connection to a power cord 2003 to provide electric power to the table. Power cord 2003 in turn is connected to an available 120V power outlet of the building/dwelling located proximate to the table. Power socket 2002 may be electrically connected to a power distribution block 2004 having wiring pin connectors or terminals for a wiring harness (not shown) to distribute electric power to the PCB 2000, audio system, lighting systems, refrigeration system, electrical outlets and USB ports, wireless charging pad, etc. already described herein. In one possible embodiment, power distribution block 2004 may be disposed on the PCB 2000 assembly. Other mounting locations in table 1000 for the distribution block 2004 may be used.

As can be seen from this disclosure, the invention (including tables 10 and 1000) provides a solution to at least the problem of providing convenient access to refrigerated or frozen items in an esthetically pleasing way in very close proximity to seating. In addition, the invention further provides "smart" tables which each incorporate various audio, visual, electronics, and electric power for interfacing with a user and their electronic devices. These features thereby advantageously provide useful enhancements and functionality beyond strict utilitarian function as a conventional table.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A multifunction table, comprising:

a base comprising a primary cavity;

a refrigeration assembly comprising a refrigeration housing located within the primary cavity of the base and a first slideable drawer coupled to the refrigeration housing, the refrigeration housing defining a refrigerated storage area having an open front end that is closed by the first slideable drawer, wherein the first slideable drawer is configured to slide relative to the refrigeration housing into and out of the refrigerated storage area;

a non-refrigerated storage assembly comprising a non-refrigerated housing located within the primary cavity of the base and a second slideable drawer coupled to the non-refrigerated housing, the non-refrigerated housing defining a non-refrigerated storage area having an open front end that is closed by the second slideable drawer, wherein the second slideable drawer is configured to slide relative to the non refrigerated housing into and out of the non-refrigerated storage area;

wherein the refrigeration housing and the non-refrigerated housing are separate components from one another and from the base; and wherein the primary cavity comprises an air space located between a rear of the refrigeration and non-refrigerated housings and a removable rear panel of the base, and further comprising a first speaker comprising a first speaker housing containing a first driver and a second speaker comprising a second speaker housing containing a second driver, the first and second speakers located in the air space.

2. The table of claim 1, wherein the table has a rectangular parallelepiped configuration having a length, a height, and a width, and wherein the table is a coffee table in which the height is smaller than the length and the width.

3. The table of claim 1, wherein the refrigeration housing and the non-refrigerated housing are positioned side-by-side within the primary cavity of the base, each of the refrigeration housing and the non-refrigerated housing extending from a bottom of the primary cavity to a top of the primary cavity.

4. The table of claim 1, wherein the non-refrigerated storage assembly comprises a third slideable drawer that is configured to slide relative to the non-refrigerated housing into and out of the non-refrigerated storage area.

5. The table of claim 1, wherein the refrigeration assembly includes a compressor located in the air space between the first and second speaker housings.

6. The table of claim 5, wherein the first speaker housing comprises a first air port that fluidly couples the first driver to the air space and the second speaker housing comprises a second air port that fluidly couples the second driver to the air space.

7. The table of claim 6, wherein when the first and second drivers are operating, the first and, second drivers move air in and out of the first and second air ports, respectively, such that air is passed around the compressor for cooling.

8. The table of claim 5, wherein a gap is provided between the removable rear panel and a remainder of the base, the gap allowing air to pass from the air space to an environment outside the table for removing heat from the compressor.

9. The table of claim 8, further comprising ventilation openings in a bottom panel of the base, the ventilation openings being fluidly connected to the air space allowing air to pass from the air space to the environment outside the table for removing heat from the compressor.

10. The table of claim 1, further comprising a control panel in a top surface of the table, wherein the control panel comprises refrigerator controls for controlling functions of the refrigeration assembly, sound controls for controlling functions of the first and second speakers, and a display for displaying information related to the first and second speakers and/or the refrigeration assembly.

11. The table of claim 10, further comprising an electrical receptacle and at least one USB port for providing electrical power to an external device and/or for connecting an external music source to the first and second speakers.

12. The table of claim 1, further comprising a front light bar disposed on a front side of the table, wherein operation of the front light bar is activated by a motion sensor configured to detect movement.

13. The table of claim 1, further comprising a rear light bar disposed on a rear panel of the base, the rear light bar controlled by a control knob on the table and operable to change color via rotating the control knob.

14. The table of claim 1, further comprising a wireless charging pad disposed in a top surface of the table for charging a personal electronic device.

15. A multifunction table, comprising:

a base comprising a primary cavity having an open front end and a removable rear panel that closes a rear end of the primary cavity;

a refrigeration unit located within the primary cavity of the base and comprising a refrigerated storage area;

a non-refrigerated storage assembly located within the primary cavity of the base and comprising a non-refrigerated storage area;

a ventilated air space located between the removable rear panel and the refrigeration unit;

a pair of speakers located within the ventilated air space, each of the speakers comprising a speaker housing that contains a speaker driver; and a compressor located within the ventilated air space between the pair of speakers, wherein the compressor is operably coupled to the refrigeration unit to cool the refrigerated storage area.

16. The table of claim 15, wherein the refrigeration unit and the non-refrigerated storage assembly are positioned side-by-side within the primary cavity of the base, each of the refrigeration unit and the non-refrigerated storage assembly extending from a bottom of the primary cavity to a top of the primary cavity.

17. The table of claim 15, wherein each of the speaker housings comprises an air port that provides a passageway between the ventilated air space and the speaker driver.

18. The table of claim 15, further comprising a motion activated lighting including an LED strip and a motion sensor, and a rear light bar disposed on a rear panel of the table, the rear light bar controlled by a control knob on the table and operable to change color via rotating the control knob.

19. The table of claim 18, further comprising a programmable controller disposed in the table and operably coupled to the rear light bar, the programmable controller wirelessly connected to a personal electronic device running software operable to change color of the rear light bar without use of the control knob.

20. The table of claim 19, wherein the programmable controller is configured to automatically turn on the rear light bar at a preset wake-up time programmed into the controller, and wherein an intensity of light emitted from the rear light bar gradually increases over a preprogrammed period of time.

* * * * *